US005858583A

United States Patent [19]

Dessauer et al.

[11] Patent Number: 5,858,583

[45] Date of Patent: Jan. 12, 1999

[54] THERMALLY IMAGEABLE MONOCHROME DIGITAL PROOFING PRODUCT WITH HIGH CONTRAST AND FAST PHOTOSPEED

[75] Inventors: Rolf Dessauer, Greenville; Jonathan V. Caspar, Henry Clay Village, both of Del.

[73] Assignee: E. I. du Pont de Nemours and Company, Wilmington, Del.

[21] Appl. No.: 888,266

[22] Filed: Jul. 3, 1997

[51] Int. Cl.[6] ..... G03C 1/675; G03C 1/705; G03C 1/73; G03C 5/58

[52] U.S. Cl. ..... 430/17; 430/332; 430/338; 430/342; 430/343; 430/344; 430/944; 430/964; 346/76.1; 346/135.1; 503/217; 503/201; 503/223; 503/224

[58] Field of Search ..... 430/338, 343, 430/344, 964, 944, 332, 342, 17; 346/76.1, 135.1; 503/217, 224, 223, 201

[56] References Cited

U.S. PATENT DOCUMENTS

| | | | |
|---|---|---|---|
| 3,042,515 | 7/1962 | Wainer | 96/48 |
| 3,042,516 | 7/1962 | Wainer | 96/48 |
| 3,383,212 | 5/1968 | Mac Lachlan | 96/48 |
| 3,390,995 | 7/1968 | Manos | 96/48 |
| 3,390,996 | 7/1968 | Mac Lachlan | 96/48 |
| 3,445,234 | 5/1969 | Cescon et al. | 430/343 |
| 3,479,185 | 11/1969 | Chambers, Jr. | 96/84 |
| 3,493,376 | 2/1970 | Fichter, Jr. | 96/90 |
| 3,563,750 | 2/1971 | Walker | 96/90 |
| 3,585,038 | 6/1971 | Cescon et al. | 430/343 |
| 3,615,454 | 10/1971 | Cescon et al. | 96/35.1 |
| 3,615,481 | 10/1971 | Looney | 96/48 |
| 3,615,567 | 10/1971 | Wilson | 96/90 R |
| 3,784,557 | 1/1974 | Cescon | 260/309 |
| 4,298,678 | 11/1981 | McKeever | 430/281 |
| 4,311,783 | 1/1982 | Dessauer | 430/270 |
| 4,332,884 | 6/1982 | Vji-Ie et al. | 430/338 |
| 4,356,252 | 10/1982 | Lee | 430/270 |
| 4,410,621 | 10/1983 | Wada et al. | 430/281 |
| 4,423,139 | 12/1983 | Isbrandt et al. | 430/338 |
| 4,495,020 | 1/1985 | Nakabayashi et al. | 156/314 |
| 4,551,413 | 11/1985 | Bell | 430/270 |
| 4,581,325 | 4/1986 | Kitchin et al. | 430/522 |
| 4,622,286 | 11/1986 | Sheets | 430/343 |
| 4,634,657 | 1/1987 | Holman, III | 430/281 |
| 4,656,121 | 4/1987 | Sato et al. | 430/495 |
| 4,743,091 | 5/1988 | Gelbart | 350/252 |
| 4,882,265 | 11/1989 | Laganis et al. | 430/522 |
| 4,929,530 | 5/1990 | Saeki et al. | 430/138 |
| 4,942,141 | 7/1990 | De Boer et al. | 503/227 |
| 4,962,009 | 10/1990 | Washizu et al. | 430/338 |
| 4,973,572 | 11/1990 | De Boer | 503/227 |
| 4,981,769 | 1/1991 | Saeki et al. | 430/338 |
| 5,019,549 | 5/1991 | Kellogg et al. | 503/227 |
| 5,051,333 | 9/1991 | Yanagihara et al. | 430/343 |
| 5,093,492 | 3/1992 | Acker et al. | 544/123 |
| 5,146,087 | 9/1992 | Vandusen | 250/271 |
| 5,156,938 | 10/1992 | Foley et al. | 430/200 |
| 5,171,650 | 12/1992 | Ellis et al. | 430/20 |
| 5,286,604 | 2/1994 | Simmons, III | 430/286 |
| 5,330,884 | 7/1994 | Fabricius et al. | 430/522 |
| 5,407,783 | 4/1995 | Cruse | 430/338 |
| 5,440,042 | 8/1995 | Fabricius et al. | 544/315 |
| 5,536,626 | 7/1996 | Fabricius et al. | 430/522 |

FOREIGN PATENT DOCUMENTS

| | | | |
|---|---|---|---|
| 0 243 936 | 11/1987 | European Pat. Off. . | |
| 335236 | 10/1989 | European Pat. Off. . | |
| 0 321 923 B1 | 2/1992 | European Pat. Off. | B41M 5/26 |
| 59-72438 | 4/1984 | Japan | G03C 1/00 |
| 60-95430 | 5/1985 | Japan | G03C 1/00 |
| 60-98433 | 6/1985 | Japan | G03C 1/80 |
| 60-191238 | 9/1985 | Japan | G03C 1/00 |
| 5-229251 | 9/1993 | Japan | B41M 5/18 |
| 5-301448 | 11/1993 | Japan | B41M 5/18 |
| 7-32738 | 2/1995 | Japan | B41M 5/18 |
| 7-228051 | 8/1995 | Japan | B41M 5/18 |
| 8-39935 | 2/1996 | Japan | B41M 5/18 |

*Primary Examiner*—Richard L. Schilling

[57] ABSTRACT

Novel thermally imageable monochrome product compositions, elements, and processes are disclosed herein. These compositions and elements characteristically have high contrast and fast imaging speeds. The thermally imageable compositions of this invention comprise (a) at least one hexaarylbiimidazole (HABI) compound, (b) at least one leuco dye, (c) at least one acid-generating compound, (d) a polymeric binder, (e) optionally at least one UV stabilizer and/or at least one inhibitor of color formation, and, in certain embodiments, (f) at least one near IR-absorbing dye. These compositions have the propensity for affording, upon thermal imaging, highly colored images having high optical density values. At the same time, background color is low in preferred compositions even after extensive exposure to ambient light. These compositions can be imagewise heated to effect color formation (i.e., generation of an image) or, in case of compositions containing at least one near IR-absorbing dye, can be imagewise exposed to near IR radiation from a laser or other device to effect color formation (i.e., generation of an image).

45 Claims, No Drawings

THERMALLY IMAGEABLE MONOCHROME DIGITAL PROOFING PRODUCT WITH HIGH CONTRAST AND FAST PHOTOSPEED

FIELD OF THE INVENTION

This invention is concerned with storage-stable, thermally imageable, color-forming compositions and elements, which are imageable with either heat and/or near infrared (near-IR) radiation. The invention is also directed to processes for forming color images employing such compositions and elements.

BACKGROUND OF THE INVENTION

Photoimageable compositions comprising hexaarylbiimidazole (HABI) compound(s) and leuco dye(s) and which are imaged using ultraviolet radiation (UV means) are known.

Additives have been reported which enhance the performance for special applications. The use of sensitizing dyes, has been reported, such as, in U.S. Pat. No. 3,563,750 to make the coatings responsive to visible light. U.S. Pat. No. 3,615,567 describes inorganic halide intensifiers in photoimageable compositions. The use of organic halogen derivatives in combination with leucodycs is described in patents issued to Photohorizons Co., such as U.S. Pat. Nos. 3,493, 376, 3,042,515, and 3,042,516, and in a patent issued to DuPont, U.S. Pat. No. 4,634,657. U.S. Pat. No. 4,495,020 describes the combination of hexaarylbiimidazoles, leuco dyes and certain photoacid generators to give coatings with enhanced electrical conductivity. Most recently, in U.S. Pat. No. 5,407,783, it was disclosed that the effectiveness of UV-induced color formation of thermally stable systems could be enhanced by the addition of certain dibromo derivatives.

Systems have been described which generate an inhibitor to color-formation by exposure to light (U.S. Pat. No. 3,390,996), heat (U.S. Pat. No. 3,390,995) or light and heat (U.S. Pat. No. 3,383,212, and U.S. Pat. No. 4,332,884). In other cases, color formation was prevented by restricting the mobility of color formation, either by use of a thermoplastic binder, which required heating of the composition before, during or subsequent to UV exposure to allow color to form (U.S. Pat. No. 3,615,481). A system also described stabilization of background after color-formation as a result of a subsequent polymerization step, effected by light or heat (U.S. Pat. No. 3,615,454) which locked the color-forming components in place.

The use of photoactive halogen compounds in combination with photosensitive biimidazoles and leuco dyes in systems containing microcapsules has been described. Other modifications in which encapsulation is employed to control background and/or image stability have been reported. Thus a number of patents (U.S. Pat. Nos. 4,929,530, 4,962,009 and 4,981,769) describe systems in which color-formation is effective inside capsules and heat is employed to rupture these in order to make contact between the components of color formation with chemical fixing agents so as to stabilize the imaged areas. Here the capsules are involved in separating the imaging and fixing components and to provide a relatively stable system. All these systems require some modicum of image stabilization to prevent significant color buildup in the unimaged areas, and "add-on" of images to previously exposed image areas is difficult. No systems have been disclosed which do not undergo significant changes when viewed in ambient light, thus reducing the ability to form color effectively when re-exposed.

Without exception, all systems described above are focused on the use of ultraviolet or visible light to produce image patterns and do not contain any disclosure or even a hint thereof on the use of heat and/or near IR radiation to effect color formation.

Early work reported that color-formation of biimidazole/leuco dye systems could be achieved with other forms of radiant energy, e.g., heat or electron-beam radiation. In U.S. Pat. No. 3,585,038, it is disclosed that, only at elevated temperatures, could color-formation be achieved with HABIs and triarylmethane leuco dye salts. German Pat. No. 2 224 725, issued to Wagner Pelikan, describes compositions of unspecified HABIs and relatively easily oxidizable leuco crystal violet, which can form colored image(s) under the influence of imagewise heating. No provision for room light stabilization of either system was reported. Most significantly, there is no disclosure or even a hint thereto in either of these two patent references of significantly improved thermally imaging compositions comprising at least one acid-generating compound in addition to a HABI compound(s) and a leuco dye(s).

Thus, in sharp contrast to photoimageable compositions imageable with ultraviolet or visible radiation, effective thermally imageable compositions are not known to the art. A need for developing efficient thermally imageable compositions has been stimulated by the requirement of producing products which have sensitivity to thermal printheads and also near-IR emitting lasers. Thus there is a continuing need for improved thermally imageable compositions.

SUMMARY OF THE INVENTION

In this invention, it has been found that color formation is surprisingly enhanced when an acid-generating compound is included together with a leuco dye and a hexaarylbiimidazole in a thermally imageable composition. The effect produced is surprisingly greater for the combination of leuco dye, HABI and acid-generating compound, than for leuco dye and HABI and/or leuco dye and acid-generating compound.

In one embodiment, the invention is a thermally imageable composition, comprising:

(a) at least one HABI compound;

(b) at least one leuco dye;

(c) at least one acid-generating compound; and (d) a polymeric binder;

wherein imaging of the composition is by thermal means using mode 1 (as defined below) with the proviso that the composition is not imaged by UV means.

In a second embodiment, the invention is a thermally imageable composition, comprising:

(a) at least one HABI compound;

(b) at least one leuco dye;

(c) at least one acid-generating compound;

(d) a polymeric binder; and (e) at least one near IR-absorbing dye;

wherein imaging of the composition is by thermal means involving exposing with near-IR radiation using mode 2 (as defined below) with the proviso that the composition is not imaged by UV means.

In a third embodiment, the invention is a thermal process for preparing an image on a substrate comprising, in order:

(i) applying an imageable composition on the substrate, wherein the imageable composition comprises:

(a) at least one HABI compound;

(b) at least one leuco dye;

(c) at least one acid-generating compound; and (d) a polymeric binder;

(ii) drying the coated imageable composition to form an imageable layer on the substrate; and (iii) imagewise heating the imageable layer to form imaged and non-imaged areas and to thereby form an image on the substrate, wherein the imagewise heating of the composition is by thermal means using mode 1 (as defined below) with the proviso that the composition is not exposed by UV means.

In a fourth embodiment, the invention is a thermal process for preparing an image on a substrate comprising, in order:

(i) applying an imageable composition on the substrate, wherein the imageable composition comprises:
(a) at least one HABI compound;
(b) at least one leuco dye;
(c) at least one acid-generating compound;
(d) a polymeric binder; and
(e) at least one near IR-absorbing dye;

(ii) drying the coated imageable composition to form an imageable layer on the substrate; and (iii) imagewise exposing the layer with near-IR radiation to form imaged and non-imaged areas and to thereby form an image on the substrate, wherein the imagewise exposing of the imageable layer is effected entirely by thermal means involving exposing with near-IR radiation using mode 2 (as defined below) with the proviso that the imagewise exposing of the imageable layer is not imaged by UV means.

For the near IR-absorbing dye structures useful in this invention that are substituted, the substitution.of alkyl, aryl, or aralkyl groups independently can be with substituents that include, but are not limited to, hydroxy, alkoxy, chloro, bromo, cyano, and amino.

DETAILED DESCRIPTION OF THE INVENTION

The thermally imageable compositions of this invention comprise (a) at least one HABI compound, (b) at least one leuco dye, (c) at least one acid-generating compound, (d) a polymeric binder, and, in certain embodiments, (e) at least one near IR-absorbing dye. Each of these components is discussed in greater detail below.

Compositions containing the above listed or similar ingredients have been effectively used in light sensitive imaging systems. However, compositions of this type which are heat sensitive, but not light sensitive, are novel.

A thermally imageable composition as defined herein is a composition in which the imaging is completely effected by thermal means, which can be either direct heating of the composition (mode 1) or, in case of compositions containing at least one near IR-absorbing dye, can also be exposure of the composition to near IR radiation (mode 2). No other type of radiation, such as ultraviolet (UV) is required or utilized in the compositions, elements, and processes of this invention, and provisions are made to exclude UV means for imaging in this invention.

The thermally imageable compositions of this invention are sensitive to heat in that colored images are formed upon heating the compositions above a certain minimum temperature required to activate color formation process(es). In sharp contrast, prior art compositions, such as those disclosed in Caruso, U.S. Pat. No. 5,407,783, differ fundamentally from the present compositions, since the former compositions are designed to be thermally stable, and the colored images are generated in an exposure step to ultraviolet radiation (UV means).

The compositions and elements of this invention can be effectively used to permit formation of add-on images. Add-on images are defined to be those images which are either created or intensified in optical density when a second or later exposure to heat and/or near infrared radiation is made at a time subsequent to the first exposure which generated the initial image. In some areas of the graphic arts, it is desirable to form images, inspect these, and add further images subsequently. Where images are developed by overall heating or stabilized by photodeactivation, formation of add-on images in acceptable density is not possible. In the compositions/elements of this invention, the images can be viewed and added to thermally.

HABI Compound(s)

A HABI thermal oxidation system includes at least one HABI compound which directly furnishes free-radicals when thermally activated. Thermal activation to generate the free-radicals can be effected either 1) by direct heating or 2) by exposure to near infrared (near-IR) radiation when the compositions contain in addition a suitable near-IR dye. In the imaging systems of this invention, the generation of free-radicals is necessary to result in formation of an image, such as, for example, by leuco dye oxidation to form color. In the compositions, elements, and processes of this invention which involve exposure to near-IR radiation, the radiation employed for imaging is limited to near-IR means and with the proviso that imaging is not effected using UV means.

Initiators for photochemical transformations, including hexaarylbiimidazole-type initiators, are discussed in: "Photopolymers: Radiation Curable Imaging Systems" by B. M. Monroe in Radiation Curing: Science and Technology, S. P. Pappas, Ed., Plenum, N.Y., 1992, pp. 399–440, and by K. K. Dietliker, in Chemistry and Technology of UV and EB Formulation for Coatings, Inks, and Paints, "Free-Radical Polymerization", P. K. T. Oldring, Ed, SITA Technology Ltd, London, Vol. 3, 1991, pp. 60–525.

Certain substituted 2,4,5,2',4',5'-hexaarylbiimidazole dimers (HABIs) useful in this invention are disclosed in: Chambers, U.S. Pat. No. 3,479,185; Cescon, U.S. Pat. No. 3,784,557; Dessauer, U.S. Pat. No. 4,311,783; and Sheets, U.S. Pat. No. 4,622,286. The HABIs disclosed in these and related patents are 2-substituted (e.g., o-Cl or o-EtO substituted) hexaphenylbiimidazoles in which the other positions on the phenyl radicals are unsubstituted or substituted with chloro, methyl or methoxy, such as:

CDM-HABI—2,2'-bis(2-chlorophenyl)-4,4',5,5'-tetrakis (3-methoxyphenyl)-1,1'-bi-1H-midazole [29777-36-4] =2-(o-chlorophenyl)-4,5 -bis(m-methoxyphenyl)-imidazole dimer o-Cl-HABI—2,2'-bis(2-chlorophenyl)-4,4',5,5'-tetraphenyl-1,1'-bi-1H-iimidazole [1707-68-2]

o-EtO-HABI—2,2'-bis(2-ethoxyphenyl)-4,4',5,5'-tetraphenyl-1,1'-bi-1H-imidazole [1842-62-2]

TCDM-HABI—"trichlorodimethoxy-hexaarylbiimidazole"=2,2',5-tris(2-chlorophenyl)-4-(3,4-dimethoxyphenyl)-4',5'-diphenylbiimidazole (and isomers);

TCTM-HABI—2,2',4,4'-tetra(2-chlorophenyl)-5,5'-bis(3,4-dimethoxyphenyl)-1,1'-bi-1H-imidazole [77388-36-4]

Other HABIs having naphthalenyl (naphthyl) substitution, such as those listed below, are useful in this invention.

N-HABI—2,2'-di(1-naphthalenyl)-4,4',5,5'-tetraphenyl-1,1'-bi-1H-imidazole [1741-29-3]

MCN-HABI—2,2'-bis(1-naphthalenyl)-4,4'-bis(2-chlorophenyl-5,5'-bis(3 -methoxyphenyl)-1,1'-Bi-1H-imidazole MN-HABI—2,2'-bis(1-naphthalenyl)-4,4',5,5'-tetrakis(3-methoxyphenyl)-1,1'-bi-1H-imidazole HABIs having naphthalenyl substitution (i.e., N-HABI) for use in photopolymerizable compositions and with photopolymerization initiated by ultraviolet (UV) means are disclosed in Wada et al., U.S. Pat. No. 4,410,621 and in Japanese Pat. No. Publications JP 59 72,438, JP 60 95,430, JP 60 191,238, JP 60 98,433, and JP Pat. No. Publ. No. 37377/70 (as cited on line 47, col. 1 of U.S. Pat. No. 4,410,621).

Suitable HABI compounds for this invention include, but are not limited to, all those listed in this specification.

Preferred HABI compounds (HABIs) for this invention include, but are not limited to, N-HABI, MN-HABI, MCN-HABI, and o-EtO-HABI.

The most preferred HABI compound for this invention is N-HABI.

The specific triphenylimidazolyl dimer(s) (HABI(s), HABI compounds) in this invention are present in 0.1 to 30 percent by weight of solids in the photoimaging compositions; preferably they are present in 5 to 25 percent by weight of solids; and most preferably they are present in 15 to 25 percent by weight of solids.

Leuco Dye

The leuco form of the dye which comprises one component of the thermal imaging composition of the present invention is the reduced form of the dye having one or two hydrogen atoms, the removal of which together with an additional electron in certain cases produces the dye. Such leuco dyes have been described, for example, in U.S. Pat. No. 3,445,234, column 2, line 49 to column 8, line 55. The following classes are included:

(a) aminotriarylmethanes (b) aminoxanthenes (c) aminothioxanthenes (d) amino-9,10-dihydroacridines (e) aminophenoxazines (f) aminophenothiazines (g) aminodihydrophenazines (h) aminodiphenylmethanes (i) leuco indamines (j) aminohydrocinnamic acids (cyanoethanes, leuco methines)

(k) hydrazines (l) leuco indigoid dyes (m) amino-2,3-dihydroanthraquinones (n) tetrahalo-p,p'-biphenols (l) 2(p-hydroxyphenyl)-4,5-diphenylimidazoles (p) phenethylanilines Of these leuco forms, (a) through (i) form the dye by losing one hydrogen atom, while the leuco forms (j) through (p) lose two hydrogen atoms to produce the parent dye. Aminotriarylmethanes are preferred. A general preferred aminotriarylmethane class is that wherein at least two of the aryl groups are phenyl groups having (a) an $R_1R_2N$-substituent in the position para to the bond to the methane carbon atom wherein $R_1$ and $R_2$ are each groups selected from hydrogen, $C_1$ to $C_{10}$ alkyl, 2-hydroxyethyl, 2-cyano-ethyl, or benzyl and, optionally, (b) a group ortho to the methane carbon atom which is selected from lower alkyl (C is 1 to 4), lower alkoxy (C is 1 to 4), fluorine, chlorine or bromine; and the third aryl group may be the same as or different from the first two, and when different is selected from (a) Phenyl which can be substituted with lower alkyl, lower alkoxy, chloro, diphenylamino, cyano, nitro, hydroxy, fluoro or bromo;

(b) Naphthyl which can be substituted with amino, di-lower alkylamino, alkylamino;

(c) Pyridyl which can be substituted with alkyl;

(d) Quinolyl;

(e) Indolinylidene which can be substituted with alkyl.

Preferably, $R_1$ and $R_2$ are hydrogen or alkyl of 1-4 carbon atoms. Leuco dye is present in 0.1 to 5.0 percent by weight of solids in the imaging composition.

Preferred leuco dyes in this invention include, but are not limited to, aminotriarylmethanes, aminoxanthenes, and leuco indigoid dyes.

Aminotriarylmethanes are preferred leuco dyes in this invention. Within this category (a)—aminotriarylmethanes—of leuco dyes, suitable aminotriarylmethane leuco dyes for this invention include, but are not limited to, LCV, D-LCV, LECV, D-LECV, LPCV, LBCV, LV-1, LV-2, LV-3, D-LV-1, D-LV-2, LB-8, aminotriarylmethane leuco dyes having different alkyl substituents bonded to the amino moieties wherein each alkyl group is independently selected from $C_1$–$C_4$ alkyl, and aminotriarylmethane leuco dyes comprising any of the preceding named structures that are further substituted with one or more alkyl groups on the aryl rings wherein the latter alkyl groups are independenly selected from $C_1$–$C_3$ alkyl. Preferred aminotriarylmethane leuco dyes according to this invention are D-LECV, LV-1, LV-2, D-LV-1, and D-LV-2. The most preferred aminotriarylmethane leuco dyes in this invention are LV-1 and LV-2.

LY-1 is a member of category (l) of leuco dyes as listed supra and is a preferred leuco dye. LM-5 is a member of category (b) of leuco dyes as listed supra and is also a preferred leuco dye.

The leuco dye(s) can be present in the compositions in any amount from 0.1 to about 25 weight percent. In most cases, it will normally be present in an amount from about 0.5 to about 18 weight percent.

Acid-Generating Compound

Various types of acid-generating compounds can be employed in the compositions of this invention individually and in combination with each other. The acid-generating compounds are those that react under thermolytic conditions, including direct heating and exposure to near-IR radiation, to afford explicit acid or to generate radicals which form acids. Acid-generating compounds that are effective in this invention include many halogenated compounds, particularly brominated compounds.

Halogenated compounds which are suitable as acid-generating compounds in this invention include, but are not limited to, substituted 1,2-dihalogenated ethanes having the structure

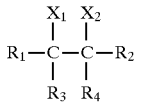

in which:

$X_1$ and $X_2$ are independently either bromine or chlorine;

$R_1$ is $C_6$–$C_{10}$ aryl, or aroyl, and $R_2$ is $C_6$–$C_{10}$ aryl, aroyl, acyl, or an electron withdrawing group other than halogen;

$R_3$ and $R_4$ independently are $C_6$–$C_{10}$ aryl, $C_1$–$C_{10}$ alkyl, H, or an electron withdrawing group other than halogen with the proviso that any two of $R_1$, $R_2$, $R_3$ and $R_4$ can form a $C_5$–$C_8$ membered ring structure; with the proviso that when $R_1$ or $R_3$ is $C_6$–$C_{10}$ aryl, $R_2$ and $R_4$ are not aryl.

The halogen ($X_1$ and $X_2$) is preferably bromine. The electron withdrawing groups are those known in the art and include carboxy, carboxy ester, cyano, nitro, and the like. Suitable compounds include those derived from the bromination of substituted stilbenes, chalcones, and styrenes.

Other halogenated compounds with structure R-$CX_3$ where X is Br or Cl or I, and R is H, R'$SO_2$—, R"CO— where R, R',R" is alkyl or aryl are effective as acid-generating compounds. An example is tribromomethylphenyl sulfone (BMPS).

Specific halogenated compounds, which are suitable as acid-generating compounds for this invention, include, but are not limited to, the following: DBC (see Caruso, U.S. Pat. No. 5,407,783), DBTCE (see Holman, U.S. Pat. No. 4,634,657), BMPS, HBCD, and TCT.

Other acid-generating compounds suitable for this invention are iodonium, phosphonium, and sulfonium salts and related compounds (see, for example, the reference: "Cationic Polymerization—Iodonium and Sulfonium Salt Photoinitiators", J. Crivello, *Adv. Polym. Science*, 1984, pages 1–48). An example of a suitable iodonium salt acid-generating compound is diaryliodonium hexafluorophosphate.

Preferred acid-generating compounds include BMPS, DBTCE, DBC, and TCT. The most preferred acid-generating compound is BMPS.

Polymeric Binder

Various binders can be used in the compositions of this invention. Suitable binders include, but are not limited to, acrylic homopolymers, such as poly($C_1$–$C_4$ alkyl acrylates); acrylic copolymers, such as copolymers of ethyl acrylate with other acrylic and methacrylic comonomers; methacrylic homopolymers, such as PMMA; methacrylic copolymers, such as copolymers of methyl methacrylate with other methacrylic and acrylic comonomers; poly(vinyl butyral); cellulose esters, such as cellulose acetate butyrate; poly(alkylene oxides), such as poly(ethylene oxide); and poly(styrene) homopolymer and copolymers, such as brominated (polystyrene).

The preferred binders are poly(vinyl butyral) and brominated poly(styrene). While optical densities of imaged areas are very suitable with use of poly(vinyl butyral) or brominated poly(styrene) as binder, surprisingly and unexpectedly it was found that compositions of the invention containing certain near IR-absorbing dyes, such as DF-1 afforded much improved background color when the binder is poly(vinyl butyral) or brominated poly(styrene) in comparison to comparable samples where another binder choice is made from the list given above.

The most preferred binder is poly(vinyl butyral), since it has overall the best combination of key properties, including significantly improved background color of compositions as discussed above, good thermal stability, coatability, compatability with ingredients, etc.

Near IR-absorbing Dye

In the imageable embodiments of this invention involving exposure to near-IR radiation to effect imaging, at least one near IR-absorbing dye is present in the compositions to absorb near IR radiation, which is subsequently converted to heat (thermal energy). The heat produced in this manner is predominantly or exclusively responsible for initiation of the color forming reaction(s) that occur in forming the image. It is believed that the heat produced subsequent to absorption of near IR radiation by a given imageable composition of this invention results in the thermal cleavage of the hexaarylbiimidazole compound(s) and the generation of triarylimidazolyl (lophyl) radicals and/or activation of the acid-generating compound to produce acid. The triarylimidazolyl radicals in synergistic combination with the products of the thermal decomposition of the acid-generating compound in turn initiate the color-forming reaction(s) involving oxidation of a leuco dye to its corresponding colored (dye) form. Additionally the increase in temperature affords both decreased local viscosity within the coating resulting in enhanced diffusion of the active species and increased rates of reaction of these species.

A variety of different near IR-absorbing dyes that are effective in absorbing near IR radiation and converting it efficiently to heat (thermal energy) can be employed in this invention. Specific suitable near IR-absorbing dyes for this invention include, but are not limited to, DF-1, SQS, RD-1, and the near IR dyes that are disclosed in U.S. patent application Ser. Nos. 08/887,240 and 08/887,808, which are being cofiled with this present application.

DF-1 and RD-1 are preferred near IR-absorbing dyes, and DF-1 is most preferred.

In addition to specific dyes as listed above, other suitable near IR dyes for this invention include, but are not limited to, those shown below:

1. Heptamethine cyanine dyes

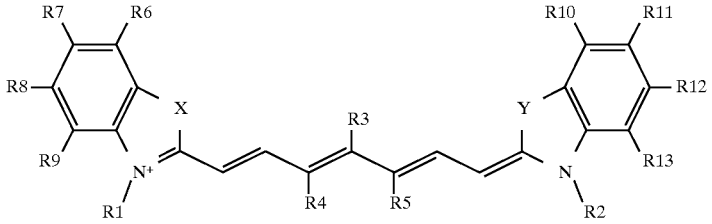

$R_3$ can be H, halogen, alkyl, aryl, alkoxy, aryloxy, thioalkyl, thioaryl. $R_4$ and $R_5$ are H, alkyl, aryl or are bridged to form a cyclic attachment. $R_6$–$R_{13}$ may or may not be the same and are H, alkyl, aryl or fused aryl. $R_1$ and $R_2$ are alkyl, aryl or substituted alkyl. X and Y which may or may not be identical=CR'R" (R', R" which may or may not be identical= H, alkyl), O, S, Se, Te. Choice of counterion for cationic dyes is dictated mainly by solubility requirements. Acceptable counterions include but are not limited to triflate, tosylate, perchlorate, hexafluorophosphate, tetrafluoroborate, iodide, chloride, bromide.

2. Benzenaminium dyes

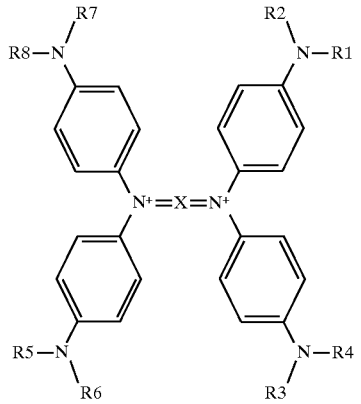

$R_1$–$R_8$ which may or may not be identical=alkyl. X=substituted 1,4-cyclohexadiene.

3. Squarylium dyes

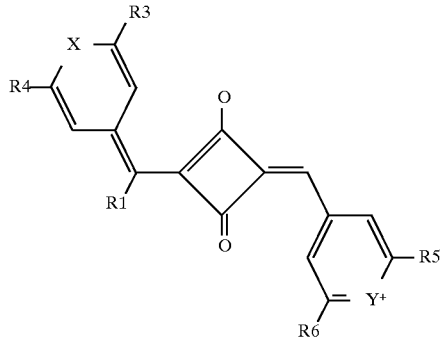

$R_1$, $R_2$ which may or may not be identical=H, alkyl. $R_3$–$R_6$ which may or may not be identical=H, alkyl. X, Y which may or may not be identical=O, S, Se, Te, N-$R_7$, $R_7$=alkyl.

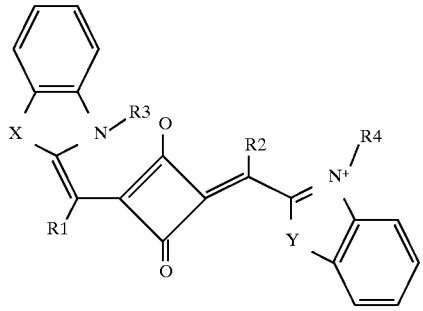

$R_1$, $R_2$ which may or may not be identical=H, alkyl. X, Y which may or may not be identical=O, S, Se, Te, N-$R_7$, $R_7$=alkyl. $R_3$ and $R_4$ are alkyl, aryl or substituted alkyl. The benzene rings may be further substituted.

With respect to the choice of near IR-absorbing dye in a given composition of this invention, the following factors are significant:

The amount of thermal energy generated is dependent on the efficiency of conversion of the near IR radiation to heat, which varies from one near IR dye to another near IR dye and which depends upon structural considerations.

The efficiency of the near IR dye is related to the overlap of the emission of the near IR source and the absorption characteristics of the dye.

UV Stabilizers

UV stabilizers can be employed in the compositions of this invention to afford improved room light stability. Surprisingly, it was found that UV stabilizers can be present in these compositions and impart significantly improved room light stability to the compositions without otherwise detracting from the performance of the compositions, such as also giving significantly less color formation.

Effective UV stabilizers for this invention are those that absorb significantly at wavelengths greater than 380 nm. Three classes of UV stabilizers that are effective in this invention are, but are not limited to, polyhydroxybenzophenones, triarylimidazoles, and hydroxyphenylbenzotriazoles.

Suitable UV stabilizers for this invention include, but are not limited to, DMDHBP, THBP, THDBBP, DHMBP, DHDMDBBP, and DPCPI. Preferred UV stabilizers in this invention are THBP, THDBBP, and DHDMDBBP. Most preferred UV stabilizers in this invention are THBP and THDBBP.

Preferred compositions of this invention include at least one UV stabilizer. UV stabilizer levels can range from 0.1 to 20 weight percent. Preferred UV stabilizer levels are in the range of 1 to 15 weight percent, and most preferred UV stabilizer levels are in the range of 3 to 10 weight percent. More than one UV stabilizer can be employed. When more than one UV stabilizer is employed, the ranges given above apply to each UV stabilizer individually, with the maximum level for the total of all UV stabilizer levels being 30 weight percent.

In many preferred embodiments of this invention, the compositions contain at least one UV stabilizer, which contributes to the room light stability of the compositions of this invention. The presence of at least one inhibitor and/or at least one UV stabilizer is critical for the compositions of this invention to possess required room light stability.

Inhibitors

Suitable inhibitors can be used in thermally imageable compositions of this invention to prevent undesired, premature color formation upon storage at or near ambient conditions. Surprisingly, it has been found that inhibitors, even those in the antioxidant class, such as BHT, can be used at quite high levels (i.e., levels as high as 21 weight percent with respect to total composition) in this invention to prevent undesired, premature color formation, and yet the presence of these inhibitors does not significantly detract from the image densities that are obtained upon thermal imaging. Inhibitors that are suitable for this invention include, but are not limited to, BHT, PD, DEHA, MBDEEP, and MBDEMP, as well as other alkyl- and aryl-substituted hydroquinones, quinones, and phenols. Preferred inhibitors are BHT, PD, DEHA, MBDEEP, and MBDEMP. The most preferred inhibitors are BHT and DEHA.

Preferred compositions of this invention include at least one inhibitor. Inhibitor levels can range from 0.1 to 30 weight percent. Preferred inhibitor levels are in the range of 1 to 25 weight percent, and most preferred inhibitor levels are in the range of 6 to 25 weight percent. More than one inhibitor can be employed. When more than one inhibitor is employed, the ranges given above apply to each inhibitor individually, with the maximum level for the total of all inhibitor levels being 30 weight percent.

In preferred embodiments of this invention, the compositions contain at least one inhibitor, which is often present at quite high levels (e.g., 15 weight percent or higher) in order for the compositions to possess adequate room light stability. The presence of at least one inhibitor and/or at least one UV stabilizer is critical for the compositions of this invention to possess required room light stability. It is very surprising and unexpected that high levels of inhibitors, including antioxidants, such as BHT, can be employed in these compositions to impart room light stability without otherwise significantly detracting from the performance of the compositions. While one skilled in the art might have expected very significant decreases in optical density values upon imaging with these high levels of inhibitor(s), in actual fact, only modest decreases were found.

Optional Component(s)

Optionally, other additives can be present in the thermally imageable compositions of this invention. For example, the thermally imageable compositions can also contain inert infusible fillers such as titanium dioxide, organophilic colloidal silica, bentonite, powdered glass, micro-sized alumina and mica in minor, noninterfering amounts. Formulations containing micro-sized silicas, as, for example, the "Syloid" silica gels, sold by W. R. Grace & Co., are particularly useful for providing a "tooth" for pencil or ink receptivity and eliminating blocking tendencies.

In preparing the compositions generally inert solvents are employed which are volatile at ordinary pressures. Examples include alcohols and ether alcohols such as methanol, ethanol, 1-propanol, 2-propanol, butanol, and ethylene glycol; esters such as methyl acetate and ethyl acetate; aromatics such as benzene, o-dichlorobenzene and toluene; ketones such as acetone, methyl ethyl ketone (butanone-2) and 3-pentanone; aliphatic halocarbons such as methylene chloride, chloroform, 1,1,2-trichloroethane, 1,1,2,2-tetrachloroethane and 1,1,2-trichloroethylene; miscellaneous solvents such as dimethylsulfoxide, pyridine, tetrahydrofuran, dioxane, dicyanocyclobutane and 1-methyl-2-oxohexmethyleneimine; and mixtures of these solvents in various proportions as may be required to attain solutions.

Useful optional antiblocking agents present to prevent the coatings from adhering to one another include $$CF_3(CF_2CF_2)_{17}CH_2CH_2\text{-}O\text{-}C(=O)(CH_2)_{16}CH_3$$

and other known agents.

There are no limitations on the amounts of optional components in this invention.

Materials of Construction

In forming a monochrome proofing product according to this invention, the thermally imageable compositions are frequently coated onto paper substrates. Both coated and uncoated papers can be employed in this invention. Other substrates can also be employed in this invention; these include, but are not limited to, polyesters, such as poly (ethylene terephthalate), and filled polyesters.

Manufacturing Process

The process of formation of an imageable dry coating is relatively simple and direct. The stable liquid imageable composition(s) of the present invention is coated onto a substrate. Various methods of coating can be employed which are well known in the art.

Substantially all solvent(s) in the liquid composition is removed which results in a dry film.

Coatings can be applied on one or both sides of preferred substrates to afford one-sided or two-sided papers or films, especially papers or filled polyester films to permit formation of two-side exposed thermal images.

Process of Use

Thermally imageable compositions of this invention may be used to prepare monochrome prints by applying heat via any device capable of delivering heat to a substrate in an imagewise fashion. Examples of devices include, but are not limited to, thermal heads and thermal styli. This application is useful in the printing of labels, receipts and output, where instant accessibility is desired, as for example in medical information printout systems.

Other thermally imageable compositions of this invention, containing NIR-absorbing dyes may be used to prepare monochrome proofing products in print-engines which depend on NIR-emitting lasers as exposure devices.

All such compositions can be applied to a substrate by coating a liquid dispersion or solution. After optional drying, if needed and selected, the coating is either imagewise heated thermally or, in case of a coating containing a near IR-absorbing dye, imagewise exposed to near infrared (NIR) radiation to effect creation of an image.

For the latter case involving imagewise exposure to near IR radiation, exposure is made with one or more near infrared emitting lasers or other devices that generate near IR radiation. The compositions used in the process of the invention generally exhibit their maximum sensitivity in the near infrared (near IR) range, which is approximately 770–1500 nm. Therefore the radiation source should furnish an effective amount of this type of radiation. Suitable radiation sources include diode lasers, e.g., gallium arsenide lasers emitting at 830 nm and Nd-YAG lasers emitting at 1064 nm.

When laser radiation sources are employed, the exposure times can be short, e.g., milliseconds or less, and with no upper limit.

Specifically in one embodiment, the invention is a thermal process for preparing an image on a substrate comprising, in order:

(i) applying an imageable composition on the substrate, wherein the imageable composition comprises:
  (a) at least one HABI compound;
  (b) at least one leuco dye;
  (c) at least one acid-generating compound; and
  (d) a polymeric binder;

(ii) drying the coated imageable composition to form an imageable layer on the substrate; and (iii) imagewise heating the imageable layer to form imaged and non-imaged areas and to thereby form an image on the substrate, wherein the imagewise heating of the composition is by thermal means using mode 1 with the proviso that the composition is not exposed by UV means.

Specifically in one other embodiment, the invention is a near infrared radiation activated process for preparing an image on a substrate comprising, in order:

(i) applying an imageable composition on the substrate, wherein the imageable composition comprises:
  (a) at least one HABI compound;
  (b) at least one leuco dye;
  (c) at least one acid-generating compound;
  (d) a polymeric binder; and
  (e) at least one near IR-absorbing dye;

(ii) drying the coated imageable composition to form a imageable layer on the substrate; and (iii) imagewise exposing the layer with near-IR radiation to form intensely colored areas and providing contrast over the non-exposed areas to thereby form an image on the substrate, wherein the imagewise exposing of the imageable layer is effected entirely by thermal means involving exposing with near-IR radiation using mode 2 with the proviso that the imagewise exposing of the imageable layer is not imaged by UV means.

This makes it possible to obtain quickly without additional processing, high quality, high contrast images which simulate the image quality of the electronically stored image which subsequently may be used to produced lithographic printing plates in similar print engines. Such plates generally require development prior to showing an image and in addition are more costly than proofing papers of this invention.

The exposed proofs can thus be examined by the user, to determine if plates generated from the electronically stored information will yield the desired print information and quality. They can be used in ambient light without significant deterioration.

In practice of use, it is often desirable to produce two-sided proofs. With these, subsequent to forming signatures (booklets), it is possible to approximate more closely the final printed document, when this is a multipage document. The materials of the process of this invention lend themselves to the manufacture and use of two-sided proofing products.

It is sometimes desirable to impose multiple images on a proofing product. It is feasible in analog proofing to use different intensities of irradiation to form differently intense dye images (color breaks) with different lithographic negatives (which subsequently are exposed to give plates which are used to print different colors) to denote the image that is generated with black ink, magenta ink, etc. With the proofing products of this invention, images can be formed with a lower level of irradiance, e.g., 250 vs. 450 mJ/cm$^2$ to show similar effects. This is an illustration of an add-on image, where the user can judge the quality of the first-formed image, prior to generating a subsequent image on the same proofing product.

Other illustrations of add-on images which are important can thus be given. It may be desirable, e.g., to use the same text but different illustrations on proofs, to illustrate what the ultimate print will look like. Thus a set of proofs can be made via a laser exposure unit (e.g., a CREO unit) with the same signal, and after having been viewed, these can subsequently be re-exposed via the with information which will result in the imposition of pictorial information. Thus, two or more images can be imposed on the same proofing product sequentially, and because the images are instantly accessible, they can be evaluated between exposures. This is an example of imposition printing.

GLOSSARY*

| | |
|---|---|
| **Leuco Dyes** | |
| LCV | tris(N,N-dimethylaminophenyl)methane = 4,4',4"-methylidynetris(N,N-dimethyl)benzenamine [603-48-5] |
| LECV | tris(N,N-diethylaminophenyl)methane = 4,4',4"-methylidynetris(N,N-diethyl)benzenamine [4865-00-3] |
| LPCV | tris(N,N-di-n-propylaminophenyl)methane = 4,4',4"-methylidynetris(N,N-di-i-propyl)benzenamine |
| LBCV | tris(N,N-di-n-butylaminophenyl)methane = 4,4',4"-methylidynetris(N,N-di-n-butyl)benzenamine |
| LV-3 | tris(4-diethylamino-2-methylphenyl)methane = 4,4',4"-methylidynetris(N,N-diethyl-3-methyl)-benzenamine [4482-70-6] |
| LV-2 | bis(4-diethylamino-2-methylphenyl) (4-diethylaminophenyl)-methane [68-582-45-6] |
| LV-1 | bis(4-diethylaminophenyl)-(4-diethylamino-2-methylphenyl) methane [60813-13-0] |
| LB-8 | bis(4-diethylamino-2-methylphenyl) (3,4-dimethoxyphenyl)-methane [4550-36-1] |
| D-LCV | deutero-tris(N,N-dimethylaminophenyl)methane |
| D-LECV | deutero-tris(4-diethylaminophenyl)methane |
| D-LV-1 | deutero-bis(4-diethylaminophenyl)-(4-diethylamino-2-methylphenyl)methane |

-continued

GLOSSARY*

| | |
|---|---|
| D-LV-2 | deutero-bis(4-diethylamino-2-methylphenyl) (4-diethylamino-phenyl)methane |
| LY-1 | trans-3-hydroxy-2-(p-diethylaminobenzyl)indanone |
| LM-5 | benzo[a]-6-N,N-diethylamino-9-(2-methoxycarbonyl)-phenylxanthene, Hodogaya Chemical Co., Ltd., Japan |
| **Biimidazoles (HABIs)** | |
| o-Cl—HABI | 2,2'-bis(2-chlorophenyl)-4,4',5,5"-tetraphenyl-1,1'-bi-1H-imidazole [1707-68-2] |
| o-EtO—HABI | 2,2'-bis(2-ethoxyphenyl)-4,4',5,5"-tetraphenyl-1,1'-bi-1H-imidazole [1842-62-2] |
| TCTM—HABI | 2,2',4,4'-tetra(2-chlorophenyl)-5,5'-bis(3,4-dimethoxy-phenyl)-1,1'-bi-1H-imidazole [77388-36-4] |
| CDM—HABI | 2,2'-bis(2-chlorophenyl)-4,4',5,5',tetrakis(3-methoxy-phenyl)-1,1'-bi-H-imidazole [29777-36-4] |
| N—HABI | 2,2'-di(1-naphthalenyl)-4,4',5,5'-tetraphenyl-1,1'-bi-1H-imidazole [1741-29-3] |
| MN—HABI | 2,2'-bis(1-naphthalenyl)-4,4',5,5'-tetrakis(3-methoxyphenyl)-1,1'-bi-1H-midazole |
| MCN—HABI | 2,2'-bis(1-naphthalenyl)-,4,4'-bis(2-chlorophenyl)-5,5'-bis(3,4-dimethoxyphenyl)-1,1'-bi-1H-imidazole |
| **Acid-Generating Compounds** | |
| BMPS | phenyl tribromomethyl sulfone [17025-47-7] |
| DBTCE | 1,2-Dibromotetrachloroethane [630-25-1] |
| DBC | dibromochalcone (dibromobenzylidene acetophenone) [611-91-6] |
| HBCD | 1,2,5,6,9,10-Hexabromocyclododecane [3194-55-6] |
| CA | tetrachloro-p-benzoquinone (chloranil) [118-75-2] |
| TCT | tristrichloromethyltriazine [6542-67-2] |
| DAHP | diaryliodonium hexafluorophosphate |
| **Inhibitors** | |
| BHT | 2,6-di-t-butyl-4-methylphenol [128-37-0] |
| PD | 1-phenyl-3-pyrazolidinone (Phenidone) [92-43-3] |
| DEHA | diethylhydroxyamine [3710-84-7] |
| MBDEEP | 2,2'-methylenebis[6-(1,1-dimethylethyl)-4-ethylphenol |
| MBDEMP | 2,2'-methylenebis[6-(1,1-dimethylethyl)-4-methylphenol |
| **UV Stabilizers (Absorbing significantly at wavelengths > 380 nm)** | |
| DMDHBP | 4,4'-dimethoxy-2,2'-dihydroxybenzophenone [131-51-4] |
| THBP | 2,2',4,4'-tetrahydroxybenzophenone [131-51-5] |
| THDBBP | 2,2',4,4'-tetrahydroxy-5,5'-di-t-butylbenzophenone [95283-23-1] |
| DHMBP | 2,2'-dihydroxy-4-methoxybenzophenone [131-51-3] |
| DHDMDBBP | 2,2'-dihydroxy-4,4'-dimethoxy-5,5'-di-t-butylbenzo-phenone |
| DPCPI | 4,5-diphenyl-2(o-chlorophenyl)imidazole [1707-67-1] |
| **Near IR-Absorbing Dyes** | |
| DF-1 | 2-[2-[2-chloro-3-[(1,3-dihydro-1,3,3-trimethyl-2H-indol-2-ylidene)ethylidene]-1-cyclopenten-1-yl]ethenyl]-1,3,3-trimethyl-3H-indolium trifluoromethanesulfonate (see U.S. Pat. No. 4,882,265) [128433-68-1] |
| RD-1 | Cyasorb ® IR-165 Near IR Dye, American Cyanamid Co., Wayne, NJ 07470 (absorption maximum at 1070 nm) [5496-71-9] |
| SQS | 4[[3-[[2,6-bis(1,10-dimethylethyl)-4H-thiopyran-4-ylidene]methyl]-2-methyl]2-hydroxy-4-oxo-2-cyclobuten-1-ylidene]methyl-2,6-bis(1,1-dimethylethyl)thiopyrilium hydroxide, inner salt, Pisgah Labs, Pisgah Forest, North Carolina [88878-49-3] |
| **Polymeric Binders** | |
| PVB | Poly(vinyl butyral) |
| Butacite ® Flake | PVB from the DuPont Company, Wilmington, DE |
| Butvar ® 90 | PVB from Monsanto, St. Louis, MO |
| PDBS-80 | Brominated poly(styrene), Great Lakes Chemical, West Lafayette, Indiana |

*The number enclosed in brackets for a given compound in the glossary is the CAS Registration Number for the given compound.

EXAMPLES

These non-limiting examples demonstrate the processes, compositions, and elements claimed and described herein. All temperatures throughout the specification are in °C. (degrees Centigrade) and all percentages are weight percentages unless indicated otherwise. All HABI's and leuco dyes (except as noted above) are from Hampford Research Stratford, Conn. Except as noted above, all other materials are from Aldrich Chemical, Milwaukee, Wis. Weights are in milligrams, unless otherwise indicated.

Exposure of materials sensitized for approximately 830 nm was effected using a CREO exposure engine (Creo Products Inc., Vancouver, British Columbia, Canada). The system used contains a rotating external drum 30 inches long and 12 inches in diameter. Samples were mounted on the rotating external drum. This CREO exposure engine contains a laser head outputting 32 individually modulated beams of approximately 70 milliwatts (mW) each, which were individually focused to approximately 7 micron spots on the sample. The rotating drum was 1 meter in circumference. The rotating drum can be spun at speeds ranging from 30 to 450 RPM to produce surface speeds on the drum ranging from 0.5 to 7.5 meters/second. Samples were held in place with adhesive tape and vacuum assist. The laser head, patented under U.S. Pat. No. 4,743,091, consisted of thirty-two approximately 830 nm, laser diodes, each with approximately 90 milliwatts of single-mode output. The laser diodes were arranged in a two dimensional 6×6 pattern of rows and columns, with columns 1 through 5 populated with 6 lasers and column 6 populated by 2 lasers. Output of each laser was passed through a collimation lens which was adjusted to focus each laser output on a plane 252 mm from the collimation lens. A two element zoom lens was used to image the 6×6 array onto the sample surface and was adjusted to determine a given spot pitch. Each individually modulated laser was focused to a 7 micron FWHM (full width at half maximum) spot. Total power on a given sample was approximately 2240 milliwatts.

Exposure of materials sensitized for 1064 nm tests was made in a YAG laser based system provided by Baasel-Scheel Lasergraphics (Itzehoe, Germany). This unit has an external drum configuration similar to that used at ~830 nm, but with a single ~0.5 to ~20 Watt modulated Gaussian beam focused to a ~25 micron spot (FWHM=full width at half maximum) on the rotating drum. The drum is ~14 inches in diameter and rotates at ~2000 rpm (revolutions per minute), with samples attached by adhesive tape to the drum surface. A leadscrew transports the imaging optics 0.001 to 0.0005 inches each time the drum turns to expose a solid area. Laser power through the modulator can be varied from ~20 Watts to ~0.6 Watts to lower exposure from ~3 J/cm$^2$ maximum to <0.2 J/cm$^2$.

EXAMPLE 1

This example illustrates that, for several different HABI compounds, significantly higher optical densities were obtained for thermal imaging (for both mode 1 involving direct thermal heating and for mode 2 involving exposure with near-IR radiation) of inventive compositions containing leuco dye, HABI compound, and acid-generating compound in relation to comparative compositions containing only 1) leuco dye and HABI or 2) leuco dye and acid-generating compound. The amount of color formed, as measured by reflectance optical density values, is inevitably higher when the imaging is done with a composition containing both an acid-generating compound and a HABI in addition to a leuco dye, indicating synergism during the image forming process.

In mode 1 thermal testing, the imaging (color formation) was effected by contacting the uncoated side of imageable sample with a hot soldering iron maintained at 370° C. for 2–3 seconds. In mode 2 thermal imaging, the imaging (color formation) was effected using a laser by imagewise exposing the imageable sample to near IR radiation of wavelength 830 nm. In the latter case, the laser was a CREO exposure unit as described supra (CREO, Inc., Vancouver, Calif.). For exposure of samples to near IR in this example to give the image densities reported in Table 1-1(see below), the amount of near IR exposure was 450 mJ/cm$^2$ in each case.

A solution S-1 was prepared as follows:

18470 mg toluene 18470 mg butanone-2

18470 mg propanol-2

3162 mg BUTACITE® flake 1580 mg LV-2

1534 mg BHT 115 mg DF-1

To 4760 mg aliquots (7.69%) of the above solution S-1, were added the ingredients (HABI, BMPS, THDBBP) as listed below. The resulting individual aliquots are designated 1-A through 1-N. The resulting solutions were coated onto Reflections II paper (Consolidated Paper Co., Inc., 231 First Ave. North, Wisconsin Rapids, Wis. 54495-0850) with a #30 wirewound rod. Each aliquot solution sample (1-A to 1-N) was coated to afford a corresponding coated sample (1-A to 1-N). These were then dried with warm air to afford the imageable film samples, which were stored at ambient conditions overnight prior to imaging. For each film sample (1-A to 1-N), one part of the sample was subjected to mode 1 thermal imaging by imagewise contacting for 2–3 seconds the film sample with a Weller WTCP Series TC202 soldering iron maintained at 370° C. A separate part of the sample was subjected to mode 2 thermal imaging by imagewise laser-exposing the sample with near IR radiation of wavelength 830 nm and having a fluence of 450 mJ/cm$^2$ using the CREO exposure unit. (Other parts of each film sample were imaged at fluence levels ranging from 150 mJ/cm$^2$ to 850 mJ/cm$^2$ as explained below.) The reflection optical densities of exposed film samples from both mode 1 thermal imaging and mode 2 thermal imaging were measured with a MACBETH reflection densitometer (MacBeth Company, Newburgh, N.Y., Model RD-114520), which was set for CYAN measurements. Optical density values measured for the sample set which were thermally imaged in mode 2 using the CREO unit are given in the column designated "Near IR". Optical density values measured for the sample set which were imaged thermally in mode 1 using the hot soldering iron are given in the column designated "Thermal".

TABLE 1-1

| Aliquot/ Coating/ Film | | Component Weights (mg) | | | Optical Densities | |
|---|---|---|---|---|---|---|
| Sample | HABI ID | HABI | BMPS | THDBBP | Near IR | Thermal |
| 1-A | N— | 68 | 15 | | 1.32 | 1.94 |
| 1-B | | | 15 | | 0.56 | 0.75 |
| 1-C | N— | 68 | | | 0.81 | 1.20 |
| 1-D | N— | 68 | 15 | 7.5 | 1.13 | 1.61 |
| 1-E | | | 15 | 7.5 | 0.60 | 0.74 |

TABLE 1-1-continued

| Aliquot/ Coating/ Film | | Component Weights (mg) | | | Optical Densities | |
|---|---|---|---|---|---|---|
| Sample | HABI ID | HABI | BMPS | THDBBP | Near IR | Thermal |
| 1-F | N- | 68 | | 7.5 | 0.77 | 0.71 |
| 1-G | o-Cl— | 68 | 15 | | 0.76 | 2.41 |
| 1-H | o-Cl— | 68 | | | 0.46 | 0.90 |
| 1-I | o-EtO— | 68 | 15 | | 0.80 | 1.24 |
| 1-J | o-EtO— | 68 | | | 0.52 | 1.50 |
| 1-K | TCTM— | 68 | 15 | | 0.74 | 2.36 |
| 1-L | TCTM— | 68 | | | 0.58 | 0.99 |
| 1-M | MCN— | 68 | 15 | | 0.95 | 1.89 |
| 1-N | MCN— | 68 | | | 0.71 | 0.89 |

where

HABI ID is identity of the HABI compound added as indicated below:

N-HABI is 2,2'-bis(1-naphthalenyl)-4,4',5,5'-tetraphenyl-1,1'-Bi-1H-imidazole o-Cl-HABI is 2,2'-bis(2-chlorophenyl)-4,4',5,5'-tetraphenyl-1,1'-Bi-1H-imidazole o-EtO-HABI is 2,2'-bis(2-ethoxyphenyl)-4,4',5,5'-tetraphenyl-1,1'-Bi-1H-imidazole TCTM-HABI is 5,5'-bis(3,4-dimethoxyphenyl)-4,4',5,5'-tetra(2-chlorophenyl)-1,1'-Bi-1H-imidazole MCN-HABI is 2,2'-bis(1-naphthalenyl)-4,4'-bis(2-chlorophenyl-5,5'-bis(3-methoxyphenyl)-1,1'-Bi-1H-imidazole BMPS is tribromomethylphenyl sulfone THDBBP is 5,5'-di-(t-butyl)-2,2',4,4'-tetrahydroxybenzophenone.

LV-2 is bis(4-diethylamino-2-methylphenyl)(4-diethylaminophenyl)methane

The composition of each coating solution (1-A through 1-P) for this example is given in the Table 1-2 below.

TABLE 1-2

| Coating Solution Composition | 1-A | 1-B | 1-C | 1-D | 1-E | 1-F | 1-G | 1-H | 1-I | 1-J | 1-K | 1-L | 1-M | 1-N |
|---|---|---|---|---|---|---|---|---|---|---|---|---|---|---|
| SOLVENT | 4275 | 4275 | 4275 | 4275 | 4275 | 4275 | 4275 | 4275 | 4275 | 4275 | 4275 | 4275 | 4275 | 4275 |
| BUTACITE | 97.6 | 97.6 | 97.6 | 97.6 | 97.6 | 97.6 | 97.6 | 97.6 | 97.6 | 97.6 | | | | |
| LV-2 | 47.7 | 47.4 | 47.4 | 47.4 | 47.4 | 47.4 | 47.4 | 47.4 | 47.4 | 47.4 | | | | |
| NHABI | 68 | | 68 | 68 | | 68 | | | | | | | | |
| o-Cl-HABI | | | | | | | 68 | 68 | | | | | | |
| o-EtO-RABI | | | | | | | | 68 | 68 | | | | | |
| TCTM-RABI | | | | | | | | | | | 68 | 68 | | |
| MCN-RABI | | | | | | | | | | | | | 68 | 68 |
| BMPS | 14.8 | 14.8 | | 14.8 | 14.8 | | 14.8 | | 14.8 | | 14.8 | | 14.8 | |
| BHT | 55.5 | 55.5 | 55.5 | 55.5 | 55.5 | 55.5 | 55.5 | 55.5 | 55.5 | 55.5 | 55.5 | 55.5 | 55.5 | 55.5 |
| THDBBP | | | | 7.4 | 7.4 | 7.4 | | | | | | | | |

The following table (Table 1-3) gives the complete set of optical densities measured for this example. The first row reports optical densities for the mode 1 thermal imaging as were reported above. The next 8 lines gives optical densities for these samples with mode 2 thermal imaging with the CREO unit in which fluence levels were varied from 850 mJ/cm$^2$ down to 150 mJ/cm$^2$ in 100 mJ/cm$^2$ increments. Finally, other key imaging parameters (BKGD) are given.

TABLE 1-3

| Parameter | 1-A | 1-B | 1-C | 1-D | 1-E | 1-F | 1-G | 1-H | 1-I | 1-J | 1-K | 1-L | 1-M | 1-N |
|---|---|---|---|---|---|---|---|---|---|---|---|---|---|---|
| Mode 1 | 1.94 | 0.75 | 1.20 | 1.61 | 0.87 | 1.29 | 2.41 | 0.90 | 2.24 | 1.15 | 2.36 | 0.99 | 1.89 | 0.89 |
| Mode 2*: | | | | | | | | | | | | | | |
| 850 | 2.13 | 0.69 | 1.12 | 1.61 | 0.74 | 0.71 | 1.39 | 0.46 | 1.79 | 0.66 | 1.21 | 0.51 | 1.41 | 0.64 |

TABLE 1-3-continued

| Parameter | 1-A | 1-B | 1-C | 1-D | 1-E | 1-F | 1-G | 1-H | 1-I | 1-J | 1-K | 1-L | 1-M | 1-N |
|---|---|---|---|---|---|---|---|---|---|---|---|---|---|---|
| 750 | 1.91 | 0.69 | 0.82 | 1.53 | 0.71 | 0.80 | 1.22 | 0.51 | 1.22 | 0.67 | 1.14 | 0.54 | 1.27 | 068 |
| 650 | 1.73 | 0.65 | 0.85 | 1.56 | 0.72 | 0.79 | 0.99 | 0.50 | 1.14 | 0.62 | 0.88 | 0.55 | 1.14 | 0.72 |
| 550 | 1.53 | 0.62 | 0.83 | 1.44 | 0.67 | 0.78 | 0.92 | 0.49 | 1.00 | 0.59 | 0.86 | 0.56 | 1.15 | 0.77 |
| 450 | 1.32 | 0.56 | 0.81 | 1.13 | 0.60 | 0.77 | 0.76 | 0.46 | 0.80 | 0.52 | 0.74 | 0.58 | 0.95 | 0.71 |
| 350 | 0.94 | 0.47 | 0.73 | 0.82 | 0.50 | 0.73 | 0.55 | 0.40 | 0.54 | 0.42 | 0.53 | 0.51 | 0.71 | 0.62 |
| 250 | 0.49 | 0.36 | 0.62 | 0.43 | 0.40 | 0.54 | 0.38 | 0.36 | 0.32 | 0.32 | 0.40 | 0.44 | 0.41 | 0.45 |
| 1SO | 0.27 | 0.25 | 0.45 | 0.22 | 0.31 | 0.42 | 0.27 | 0.31 | 0.30 | 0.30 | 0.26 | 0.40 | 0.28 | 0.41 |
| BKGD | 0.22 | 0.23 | 0.40 | 0.21 | 0.24 | 0.40 | 0.20 | 0.29 | 0.21 | 0.29 | 0.19 | 0.38 | 0.21 | 0.28 |
| 60s BLB | 0.51 | 0.37 | 0.40 | 0.29 | 0.28 | 0.40 | 0.38 | 0.29 | 0.45 | 0.26 | 0.38 | 0.33 | 0.46 | 0.28 |

*Numbers are fluence levels in $mJ/cm^2$

BKGD = optical density measured for a given unexposed sample.

60s BLB = exposure in contact printer approximately 2 inches from a series of closely spaced Black Lite Blue fluorescent lamps, manufactured by GTE-Sylvania.

Table 1-3 shows that these compositions are poorly imaged with UV radiation but are effectively imaged with NIR.

As indicated earlier, this example illustrates that the inventive thermally imageable compositions, comprising a leuco dye, a HABI compound, and an acid-generating compound, afford significantly higher optical densities upon either mode 1 thermal imaging or mode 2 thermal imaging in comparison to comparative compositions comprising 1) leuco dye and HABI compound or 2) leuco dye and acid-generating compound and with the comparative compositions lacking all three component types being present together in the same composition. This key finding is illustrated by the results obtained for this example as summarized in Table 1-1. In this example the leuco dye is LV-2 in each of the samples 1-A through 1-N. Five different HABI compounds were tested as indicated for the individual samples in Table 1-1.

With reference to Table 1-1, film sample 1-A (containing LV-2, N-HABI, BMPS) afforded significantly higher optical density values than did comparative film samples 1-B (containing LV-2 and BMPS, but no HABI) and 1-C (containing LV-2 and N-HABI, but no acid-generating compound). This finding was established for both the mode 1 and mode 2 thermally imaged samples.

Similarly, the above finding was established for other HABI compounds. Sample 1-G (containing LV-2, o-Cl-HABI, and BMPS) afforded significantly higher optical densities than did film sample 1-H (containing LV-2 and o-Cl-HABI, but no acid-generating compound). Sample 1-I (containing LV-2, o-EtO-HABI, and BMPS) afforded significantly higher optical densities than did film sample 1-J (containing LV-2 and o-EtO-HABI, but no acid-generating compound). Sample 1-K (containing LV-2, TCTM-HABI, and BMPS) afforded significantly higher optical densities than did film sample 1-L (containing LV-2 and TCTM-HABI, but no acid-generating compound). Sample 1-M (containing LV-2, MCN-HABI, and BMPS) afforded significantly higher optical densities than did film sample 1-N (containing LV-2 and MCN-HABI, but no acid-generating compound). For each of these pairs of film samples, the sample (inventive sample) containing leuco dye, HABI compound, and acid-generating compound afforded significantly higher optical densities for both mode 1 and mode 2 thermal imaging than did the corresponding sample (comparative sample) in the pair that contained only leuco dye and HABI compound.

This example also illustrates that the two naphthalenyl-substituted HABI compounds (N-HABI and MCN-HABI) were more effective on an equal weight basis in affording higher optical densities in comparison to the other HABIs tested. This can be seen from the data in Table 1-1. Of the film samples comprising leuco dye, HABI compound, and acid-generating compound, the two that afforded the highest optical densities were film samples 1-A (containing N-HABI) and 1-M (containing MCN-HABI). Both of these are naphthyl-substituted HABIs. The other HABIs as listed in Table 1-1 are not naphthyl-substituted and each of these afforded substantially lower optical densities for both mode 1 thermal (Optical Densities, Thermal column) and mode 2 thermal (Optical Densities, Near IR column) cases. For this reason, naphthalenyl-substituted HABIs, e.g., N-HABI, are the most preferred HABI compounds in this invention.

EXAMPLE 2

This example illustrates that, for each of several different acid-generating compounds, significantly higher optical densities were obtained for both mode 1 and mode 2 thermal imaging of inventive compositions containing leuco dye, HABI compound, and acid-generating compound in relation to comparative compositions containing only 1) leuco dye and HABI or 2) leuco dye and acid-generating compound.

The mode 1 and mode 2 thermal imaging in this example was the same as in Example 1 unless noted otherwise.

A solution S-2 was prepared as follows:

11957 mg toluene 11957 mg butanone-2

11957 mg propanol-2

2047 mg BUTACITE® flake 1019 mg L,V-2

993 mg BHT 71 mg DF-1

To 4477 mg aliquots (11.19%) of the above solution S-2, were added the ingredients (N-HABI, and BMPS, DBC, or DBTCE) as listed below. The resulting individual aliquots are designated 2-A through 2-H. The resulting solutions were coated onto "Reflections" paper (Consolidated Paper Co., Inc., 231 First Avenue North, Wisconsin Rapids, Wis. 54495-0850) with a #30 wirewound rod. Each aliquot solution sample (2-A to 2-H) was coated to afford a corresponding coating sample (2-A to 2-H). The resulting coatings were dried with warm air to afford the imageable film samples, which were stored at ambient conditions overnight prior to imaging. For each film sample (2-A to 2-H), one part of the sample was subjected to mode 1 thermal imaging and other parts were subjected to mode 2 thermal imaging in the manners given in Example 1. Optical densities were measured on the MACBETH reflection densitomer to afford the data shown in Table 2-1.

TABLE 2-1

| Aliquot/ Coating/ Film Sample | N-HABI | Component Weights (mg) BMPS | DBC | DBTCE | Optical Densities Near IR | Thermal |
|---|---|---|---|---|---|---|
| 2-A | 68 | 15 | | | 1.50 | 2.12 |
| 2-B | | 15 | | | 0.61 | 0.80 |
| 2-C | 68 | | | | 0.62 | 0.96 |
| 2-D | 68 | | 15 | | 1.28 | 2.44 |
| 2-E | | | | | 0.55 | 1.07 |
| 2-F | 68 | | | 15 | 1.55 | 1.62 |
| 2-G | | | | 15 | 0.76 | 0.81 |
| 2-H | | | | | 0.30 | 0.68 |

The composition of each coating solution (2-A through 2-H) for this example is given in the Table 2-2 below.

TABLE 2-2

| Coating Solution Composition | Component Weights (mg) 2-A | 2-B | 2-C | 2-D | 2-E | 2-F | 2-G | 2-H |
|---|---|---|---|---|---|---|---|---|
| SOLVENT | 4275 | 4275 | 4275 | 4275 | 4275 | 4275 | 4275 | 4275 |
| BUTACITE | 98 | 98 | 98 | 98 | 98 | 98 | 98 | 98 |
| LV-2 | 49 | 49 | 49 | 49 | 49 | 49 | 49 | 49 |
| NHABI | 68 | | 68 | 68 | | 68 | | |
| DBTCE | | | | | | 15 | 15 | |
| DBC | | | | 15 | 15 | | | |
| BMPS | 15 | 15 | | | | | | |
| BHT | 55.5 | 55.5 | 55.5 | 55.5 | 55.5 | 55.5 | 55.5 | 55.5 |

The following table (Table 2-3) gives the complete set of optical densities measured for this example. The first row reports optical densities for the mode 1 thermal imaging as were reported above. The next 8 lines gives optical densities for these sample with mode 2 thermal imaging involving exposure with near-IR with the CREO unit in which fluence levels of near-IR radiation were varied from 850 mJ/cm$^2$ down to 150 mJ/cm$^2$ in 100 mJ/cm$^2$ increments (as indicated in the first column having no heading). Finally, another key imaging parameter (BKGD, the optical density for the unexposed film sample) was determined.

TABLE 2-3

| | Reflectance Density 2-A | 2-B | 2-C | 2-D | 2-E | 2-F | 2-G | 2-H |
|---|---|---|---|---|---|---|---|---|
| MODE 1 | 2.12 | 0.80 | 0.96 | 2.44 | 1.07 | 1.62 | 0.81 | 0.68 |
| MODE *2: | | | | | | | | |
| 850 | 1.82 | 0.67 | 0.74 | 1.75 | 0.55 | 2.03 | 0.58 | 0.31 |
| 750 | 1.87 | 0.62 | 0.70 | 1.63 | 0.54 | 1.86 | 0.55 | 0.30 |
| 650 | 1.76 | 0.71 | 0.69 | 1.48 | 0.51 | 1.81 | 0.56 | 0.34 |
| 550 | 1.68 | 0.65 | 0.69 | 1.41 | 0.57 | 1.76 | 0.55 | 0.28 |
| 450 | 1.50 | 0.61 | 0.62 | 1.28 | 0.55 | 1.55 | 0.76 | 0.30 |
| 350 | 1.15 | 0.57 | 0.52 | 1.00 | 0.49 | 1.22 | 0.55 | 0.37 |
| 250 | 0.67 | 0.46 | 0.37 | 0.62 | 0.41 | 0.75 | 0.38 | 0.33 |
| 150 | 0.31 | 0.34 | 0.28 | 0.32 | 0.29 | 0.35 | 0.27 | 0.30 |
| BKGD | 0.21 | 0.25 | 0.27 | 0.24 | 0.29 | 0.26 | 0.20 | 0.31 |

*Numbers are fluence levels in mJ-cm$^2$.

As indicated earlier, this example illustrates that, for each of several different acid-generating compounds, the inventive thermally imageable compositions, comprising a leuco dye, a HABI compound, and an acid-generating compound, afford significantly higher optical densities upon either mode 1 thermal imaging or mode 2 thermal imaging in comparison to comparative compositions comprising 1) leuco dye and HABI compound or 2) leuco dye and acid-generating compound and with the comparative compositions lacking all three component types being present together in the compositions. This key finding is illustrated by the results obtained for this example as summarized in Table 2-1. In this example the leuco dye is LV-2 and the HABI, if present, is N-HABI in each of the samples 2-A through 2-H.

With reference to Table 2-1, film sample 2-A (containing LV-2, N-HAB I, BMPS) afforded significantly higher optical density values than did comparative film samples 2-B (containing LV-2 and BMPS, but no HABI) and 2-C (containing LV-2 and N-HABI, but no acid-generating compound). This finding was established for both the mode 1 thermal and mode 2 thermal imaged samples.

Similarly, the above finding was established for other acid-generating compounds, i.e., DBC and DBTCE. Sample 2-D (containing LV-2, N-HABI, and DBC) afforded significantly higher optical densities than did film sample 2-E (containing LV-2 and DBC, but no HABI). Sample 2-F (containing LV-2, N-HABI, and DBTCE) afforded significantly higher optical densities than did film sample 2-G (containing LV-2 and DBTCE, but no HABI).

Sample 2-H was a control sample containing LV 2, but containing no HABI nor acid-generating compound. It afforded the lowest optical densities measured in the sample 2-A through H series.

For each of these pairs or trios of film samples, the sample (inventive sample) containing leuco dye, HABI compound, and acid-generating compound afforded significantly higher optical densities for both mode 1 thermal and mode 2 thermal imaging than did the corresponding comparative sample(s)) in the pair or trio that contained only 1) leuco dye and HABI compound or 2) leuco dye and acid-generating compound. This key finding was established for trio 2-A/2-B/2-C as well as for pairs 2-D/2-E and 2-F/2-G.

This example also illustrates that for mode 2 thermal imaging with near IR radiation, the order of acid-generating compound efficacy on an equal weight basis for affording high optical density is as follows: DBTCE is more effective than BMPS which in turn is more effective than DBC. This can be seen from the data in Table 2-1 in which sample 2-F had the highest optical density, sample 2-A the next highest, and sample 2-D, the next highest.

EXAMPLE 3

This example series illustrates that, for each of several different leuco dyes, significantly higher optical densities were obtained for both mode 1 thermal imaging and mode 2 thermal imaging of inventive compositions containing leuco dye, HABI compound, and acid-generating compound in relation to comparative compositions containing only 1) leuco dye and HABI or 2) leuco dye and acid-generating compound.

The HABI compound in this example series (3-A through 3-R) was N-HABI, and the acid-generating compound was BMPS. The near IR dye used was SQS. The different leuco dyes tested in this example series were as follows: LV-1 (3-A/3-B/3-C), D-LECV (3-D/3-E/3-F), LV-3 (3-G/3-H/3-I), LM-5 (3-J/3-K/3-L), LY-1 (3-M/3-N/3-O), and LV-2 (3-P/3-Q/3-R).

The mode 1 thermal imaging and mode 2 thermal imaging in this example was the same as in Example 1 unless noted otherwise. In this example, as throughout the specification, OD=optical density. The OD of the unexposed sample was measured and is the background (BKGD). The OD of the exposed sample was measured after exposure to near IR radiation at an exposure level (fluence) of 450 mJ/cm$^2$; this OD value is the $OD_{exposed}$. The contrast is defined as below:

$$\text{Contrast}=OD_{exposed}-\text{BKGD}$$

In this example, all optical density (OD) readings were made with a Macbeth Reflectance densitometer set for cyan measurements, except for samples 3-J, 3-K and 3-L, for which the magenta setting was employed and for samples 3-M, 3-N and 3-O, for which the yellow setting was employed.

EXAMPLE 3-A

A solution containing 1464 mg toluene, 1464 mg butanone-2 and 1464 mg propanol-2, 251 mg Butacite® Flake, 8.67 mg SQS, 43.9 mg N-HABI, 30.8 mg bis (4-diethylaminophenyl)-(4-diethylamino-2-methylphenyl) methane (LV-1) and 9.7 mg phenyl tribromomethyl sulfone was coated with a #29 wirewound rod onto Reflections II paper. After air drying, the unexposed sample had OD 0.35. Exposure to 450 mJ/cm of NIR irradiation in the CREO and gave OD of 0.56. Contrast was thus 0.21. Treating with a hot surface gave OD of 2.48.

EXAMPLE 3-B

Example 3-A was repeated, but the N-HABI was omitted. The solution was coated with a #29 wirewound rod onto Reflections II paper. After air drying, the unexposed sample had OD 0.10. The sample was exposed to 450 mJ/cm$^2$ of NIR irradiation in the CREO and gave OD of 0.16. Contrast was thus 0.06. Treating with a hot surface gave OD of 0.83.

EXAMPLE 3-C

Example 3-A was repeated, but the phenyl tribromomethyl sulfone was omitted. The solution coated with a #29 wirewound rod onto Reflections II paper. After air drying, the unexposed sample had OD 0.29. The sample was exposed to 450 mJ/cm$^2$ of NIR irradiation in the CREO and gave OD of 0.29. Contrast was thus 0.0. Treating with a hot surface gave OD of 1.13.

EXAMPLE 3-D

A solution containing 1464 mg toluene, 1464 mg butanone-2, 1464 mg propanol-2, 251 mg Butacite® Flake, 8.67 mg SQS, 43.9 mg N-HABI, 28.4 mg deutero-tris(4-diethylaminophenyl)methane (D-LECV) and 9.7 mg phenyl tribromomethyl sulfone was coated with a #29 wircwound rod onto Reflections II paper. After air drying, the unexposed sample had OD 0.27. The sample was exposed to 450 mJ/cm$^2$ of NIR irradiation in the CREO and gave OD of 0.81. Contrast was thus 0.54. Treating with a hot surface gave OD of 2.26.

EXAMPLE 3-E

Example 3-D was repeated, but N-HABI was omitted. The solution coated with a #29 wirewound rod onto Reflections II paper. After air drying, the unexposed sample had OD 0.08. The sample was exposed to 450 mJ/cm$^2$ of NIR irradiation in the CREO and gave OD of 0.27. Contrast was thus 0.19. Treating with a hot surface gave OD of 0.86.

EXAMPLE 3-F

Example 3-D was repeated, but the phenyl tribromomethyl sulfone was omitted. The solution coated with a #29 wirewound rod onto Reflections II paper. After air drying, the unexposed sample had OD 0.23. The sample was exposed to 450 mj/cm$^2$ of NIR irradiation in the CREO and gave OD of 0.26. Contrast was thus 0.03. Treating with a hot surface gave OD of 0.86.

EXAMPLE 3-G

A solution containing 1464 mg toluene, 1464 mg butanone-2, 1464 mg propanol-2, 251 mg Butacite® Flake, 8.67 mg SQS, 43.9 mg N-HABI, 32.3 mg tris(4-diethylamino-2-methylphenyl)methane (LV-3) and 9.7 mg phenyl tribromomethyl sulfone was coated with a #29 wirewound rod onto Reflections II paper. After air drying, the unexposed sample had OD 0.09. The sample was exposed to 450 mJ/cm$^2$ of NIR irradiation in the CREO and gave OD of 0.27. Contrast was thus 0.18. Treating with a hot surface gave OD of 0.67.

EXAMPLE 3-H

Example 3-G was repeated, but N-HABI was omitted. The solution coated with a #29 wirewound rod onto Reflections II paper. After air drying, the unexposed sample had OD 0.07. The sample was exposed to 450 mJ/cm$^2$ of NIR irradiation in the CREO and gave OD of 0.20. Contrast was thus 0.13. Treating with a hot surface gave OD of 0.38.

EXAMPLE 3-I

Example 3-G was repeated, but the phenyl tribromomethyl sulfone was omitted. The solution coated with a #29 wirewound rod onto Reflections II paper. After air drying, the unexposed sample had OD 0.10. The sample was exposed to 450 mJ/cm$^2$ of NIR irradiation in the CREO and gave OD of 0.23. Contrast was thus 0.13. Treating with a hot surface gave OD of 0.59.

EXAMPLE 3-J

A solution containing 1464 mg toluene, 1464 mg butanone-2 and 1464 mg propanol-2, 251 mg Butacite® Flake, 8.67 mg SQS, 43.9 mg N-HABI, 38.7 mg of LM-5 and 9.7 phenyl tribromomethyl sulfone was coated with a #29 wirewound rod onto Reflections II paper. After air drying, the unexposed sample had OD 0.16. The sample was exposed to 450 mJ/cm$^2$ of NIR irradiation in the CREO and gave OD of 0.46. Contrast was thus 0.30. Treating with a hot surface gave OD of 1.34.

EXAMPLE 3-K

Example 3-J was repeated, but N-HABI was omitted. The solution coated with a #29 wirewound rod onto Reflections II paper. After air drying, the unexposed sample had OD 0.12. The sample was exposed to 450 mJ/cm$^2$ of NIR irradiation in the CREO and gave OD of 0.21. Contrast was thus 0.09. Treating with a hot surface gave OD of 0.67.

EXAMPLE 3-L

Example 3-J was repeated, but the phenyl tribromomethyl sulfone was omitted. The solution coated with a #29 wirewound rod onto Reflections II paper. After air drying, the unexposed sample had OD 0.15. The sample was exposed to 450 mJ/cm$^2$ of NIR irradiation in the CREO and gave OD of 0.35. Contrast was thus 0.20. Treating with a hot surface gave OD of 0.79.

EXAMPLE 3-M

A solution containing 1464 mg toluene, 1464 mg butanone-2 and 1464 mg propanol-2, 251 mg Butacite® Flake, 8.67 mg SQS, 43.9 mg N-HABI, 22.6 mg trans-3-hydroxy-2-(p-diethylaminobenzyl)indanone (LY-1) and 9.7 mg phenyl tribromomethyl sulfone was coated with a #29 wirewound rod onto Reflections II paper. After air drying, the unexposed sample had OD 0.26. The sample was exposed to 450 mJ/cm$^2$ of NIR irradiation in the CREO and gave OD of 0.49. Contrast was thus 0.23. Treating with a hot surface gave OD of 0.94.

EXAMPLE 3-N

Example 3-M was repeated, but N-HABI was omitted. The solution coated with a #29 wirewound rod onto Reflections II paper. After air drying, the unexposed sample had OD 0.17. The sample was exposed to 450 mJ/cm$^2$ of NIR irradiation in the CREO and gave OD of 0.25. Contrast was thus 0.08. Treating with a hot surface gave OD of 0.74.

EXAMPLE 3-O

Example 3-M was repeated, but the phenyl tribromomethyl sulfone was omitted. The solution coated with a #29 wirewound rod onto Reflections II paper. After air drying, the unexposed sample had OD 0.24. The sample was exposed to 450 mJ/cm$^2$ of NIR irradiation in the CREO and gave OD of 0.37. Contrast was thus 0.13. Treating with a hot surface gave OD of 0.77.

EXAMPLE 3-P

A solution containing 1464 mg toluene, 1464 mg butanone-2, 1464 mg propanol-2, 251 mg Butacite® Flake, 8.67 mg SQS, 43.9 mg N-HABI, 31.8 mg bis(4-diethylamino-2-methylphenyl)-(4-diethylaminophenyl) methane (LV-2) and 9.7 mg phenyl tribromomethyl sulfone was coated with a #29 wirewound rod onto Reflections II paper. After air drying, the unexposed sample had OD 0.17. The sample was exposed to 450 mJ/cm$^2$ of NIR irradiation in the CREO and gave OD of 0.62. Contrast was thus 0.45. Treating with a hot surface gave OD of 2.53.

EXAMPLE 3-Q

Example 3-P was repeated, but the N-HABI was omitted. The solution coated with a #29 wirewound rod onto Reflections II paper. After air drying, the unexposed sample had OD 0.17. The sample was exposed to 450 mJ/cm$^2$ of NIR irradiation in the CREO and gave OD of 0.12. Contrast was thus 0.08. Treating with a hot surface gave OD of 0.64.

EXAMPLE 3-R

Example 3-P was repeated, but the phenyl tribromomethyl sulfone was omitted. The solution coated with a #29 wirewound rod onto Reflections II paper. After air drying, the unexposed sample had OD 0.11. The sample was exposed to 450 mJ/cm$^2$ of NIR irradiation in the CREO and gave OD of 0.37. Contrast was thus 0.26. Treating with a hot surface gave OD of 0.50.

As indicated earlier, this example illustrates that, for several different leuco dyes, the inventive thermally imageable compositions, comprising a leuco dye, a HABI compound, and an acid-generating compound, afford significantly higher optical densities upon either mode 1 thermal imaging or mode 2 thermal imaging compared to compositions comprising 1) leuco dye and HABI compound or 2) leuco dye and acid-generating compound and with the comparative compositions lacking all three component types being present together in the same composition. This key finding is illustrated by the results obtained in this Example 3 series, i.e., Examples 3-A through 3-R.

Film sample 3-A (containing LV-1, N-HABI, BMPS) afforded significantly higher optical density values than did comparative film samples 3-B (containing LV-1 and BMPS, but no HABI) and 3-C (containing LV-1 and N-HABI, but no BMPS or other acid-generating compound). This finding was established for both the mode 1 thermally imaged samples and for the mode 2 thermally imaged samples.

Similarly, the above finding was established for other leuco dyes tested in this Example 3 series. Film sample 3-D (containing D-LECV, N-HABI, BMPS) afforded significantly higher optical density values than did comparative film samples 3-E (containing D-LECV and BMPS, but no HABI) and 3-F (containing D-LECV and N-HABI, but no BMPS or other acid-generating compound). Film sample 3-G (containing LV-3, N-HABI, BMPS) afforded significantly higher optical density values than did comparative film samples 3-H (containing LV-3 and BMPS, but no HABI) and 3-I (containing LV-13 and N-HABI, but no BMPS or other acid-generating compound). Film sample 3-J (containing LM-5, N-HABI, BMPS) afforded significantly higher optical density values than did comparative film samples 3-K (containing LM-5 and BMPS, but no HABI) and 3-L (containing LM-5 and N-HABI, but no BMPS or other acid-generating compound). Film sample 3-M (containing LY-1, N-HABI, BMPS) afforded significantly higher optical density values than did comparative film samples 3-N (containing LY-1 and BMPS, but no HABI) and 3-O (containing LY-1 and N-HABI, but no BMPS or other acid-generating compound). Film sample 3-P (containing LV-2, N-HABI, BMPS) afforded significantly higher optical density values than did comparative film samples 3-Q (containing LV-2 and BMPS, but no HABI) and 3-R (containing LV-2 and N-HABI, but no BMPS or other acid-generating compound).

EXAMPLE 4

This example illustrates the advantageous effect of including inhibitors in the compositions of this invention. Background color, which is measured as optical density (OD) on a given unexposed film sample, is stabilized in compositions with inhibitor(s). At the same time, high visual contrast is retained in the film sample. Without inclusion of inhibitor(s), the background color is not stable and increases significantly with the time exposed to ambient white light.

In this example, the background color of each film sample tested was determined for the film sample before and after room light exposure to 40 foot-candles of white light for 12 hours.

EXAMPLE 4A

A solution containing 14.23 g toluene (31.81%), 14.23 g butanone-2 (31.81%) and 14.23 mg propanol-2 (31.81%), 1.410 g poly(vinylbutyral) (3.15%), 31.0 mg DF-1 (0.07%), 353 mg N-HABI (0.79%), 50 mg LV-2 (0.11%), 203 mg DBTCE (0.45%), was coated with a #30 wirewound rod onto 32HG paper (Schweitzer-Mauduit International, Inc., Suite 600, 100 North Point Center East, Alpharetta, Ga). After air-drying, the unexposed sample had OD=0.10. Exposure to 450 mJ/cm$^2$ of NIR irradiation in the CREO was gave OD=1.69. Contrast was thus 1.59. When the sample was exposed to 40 foot-candles of room light for 12 hours, the background color of unexposed areas (to near IR radiation) changed to 1.38. The contrast after room light exposure thus was 0.31.

EXAMPLE 4B

A solution containing 15.853 g toluene (31.42%), 15.83 g butanone-2 (31.42%) and 15.83 mg propanol-2 (31.42%), 1.580 g poly(vinylbutyral) (3.13%), 54 mg DF-1 (0.11%), 396 mg N-HABI (0.78%), 55 mg LV-2 (1.09%), 228 mg DBTCE (0.45%), 18 mg phenidone (0.04%) and 71 mg diethylhydroxyamine (0.14%) was coated with a #30 wirewound rod onto 32HG paper. After air-drying, the unexposed sample had OD=0.15. Exposure to 450 mJ/cm$^2$ of NIR irradiation in the CREO gave OD=1.68. Contrast was thus 1.53. When the sample was exposed to 40 foot-candles of room light for 12 hours, the background color of unexposed areas (to near IR radiation) changed to 0.43 which is 12HR-RL. The contrast after room light exposure thus was 1.25.

EXAMPLE 5

This example illustrates the advantageous effect of including a UV stabilizer in the compositions of this invention. Background color, which is measured as optical density (OD) on a given unexposed film sample, is stabilized in compositions with a suitable UV stabilizer. At the same time, high visual contrast is retained in the film sample. Without inclusion of a UV absorber, the background color is not stable and increases significantly with the time exposed to ambient white light.

In this example, the background color of each film sample tested was determined for the film sample before and after room light exposure to 40 foot-candles of white light for 12 hours. The UV absorber additives selected below were found to improve the background stability and give better visual contrast.

EXAMPLE 5A

A solution containing 62271 mg toluene (31.47%), 62271 mg butanone-2 (31.47%) and 62271 mg propanol-2 (31.47%), 6059 mg BUTACITE® Flake, 172 mg DF-1 (0.11%), 3181 mg N-HABI (1.09%), 1584 D-LECV (0.78%), 686 mg BMPS (0.46%), 677 mg diethylhydroxylamine and 832 mg BHT was coated with a #30 wirewound rod onto 32HG paper. After air-drying, the unexposed sample had OD=0.10. Exposure to 450 mJ/cm$^2$ of NIR irradiation in the CREO gave OD=0.97. Contrast was thus 0.87. Treating with a hot surface at 370° C. for 3 seconds gave OD of 1.47. When the sample was exposed to 40 foot-candles of roomlight for 12 hours, the background color of unexposed areas (to nearIR radiation) changed to 0.37, which is 12 HR-RL. The contrast after room light exposure thus was 0.60.

EXAMPLE 5B

To 15000 mg of the above solution from Example 5A was added 123 mg THDBBP, and the sample was then coated as above. After air-drying, the unexposed sample had OD=0.11, which is BKGD. Exposure to 450 mJ/cm$^2$ of NIR irradiation in the CREO gave OD=0.91. Contrast was thus 0.82. Treating with a hot surface at 370° C. for 3 seconds gave OD of 1.51. When the sample was exposed to 40 foot-candles of room light for 12 hours, the background color of unexposed areas (to near IR radiation) changed to 0.22, which is 12HR-RL. The contrast thus was 0.68.

EXAMPLE 5C

To 15000 mg of the above solution from Example 5A was added 120 mg of 4,5-diphenyl-2-(o-chlorophenyl) imidazole, and the sample was then coated as above. After air-drying, the unexposed sample had OD=0.09, which is BKGD. Exposure to 450 mJ/cm$^2$ of NIR irradiation in the CREO gave OD=1.00. Contrast was thus 0.91. Treating with a hot surface at 370° C. for 3 seconds gave OD of 1.51. When the sample was exposed to 40 foot-candles of room light for 12 hours, the background color of unexposed areas changed to 0.28, which is 12HR-RL. The contrast thus was 0.72.

The key parameter in this example to characterize background stability of the film sample is (12HR-RL)—BKGD; this key parameter is just the difference between the two optical density measurements, BKGD being measured on the sample prior to any room light exposure and 12HR-RL being measured on the sample after the 12 hour exposure to room light at a level of 40 foot-candles. Both are optical density values measured in the manner defined supra. The three samples exhibited the following for this key parameter:

| Sample | (12HR-RL) − BKGD | Initial Contrast | Final Contrast |
|---|---|---|---|
| 5a | 0.27 | 0.87 | 0.60 |
| 5b | 0.11 | 0.82 | 0.68 |
| 5c | 0.19 | 0.91 | 0.72 |

Sample 5a does not contain a UV stabilizer and was found to exhibit the highest value of this key parameter, which indicates it has the lowest (poorest) room light stability. Samples 5b and 5c, which contain respectively a known UV stabilizer (DBTHBP, in sample 5b) and a novel UV stabilizer 4,5-diphenyl-2-(o-chlorophenyl)imidazole in sample 5c), both exhibited lower values for this key parameter, indicating they have higher (better) room light stabilities, with 5b being the best. These UV stabilizers significantly improved the room light stabilities of these compositions without significantly detracting from the contrast levels. For example, the initial contrast values were 0.87, 0.82 and 0.91 and the later contrast values were 0.60, 0.68 and 0.72 for samples 5a, 5b and 5c, respectively. Thus, in fact, not only were the later contrast values (after exposure to 40 foot-candles of room light) not reduced with inclusion of a UV stabilizer in the composition, these contrast values were actually improved significantly. As illustrated above, inclusion of a UV stabilizer in the imageable composition does not significantly detract from the high optical densities that are achieved using the three key components—leuco dye, HABI compound, and acid-generating compound in the imageable compositions and yet there is clear advantage to including a UV stabilizer in that the room light stability of the composition is significantly improved with the UV stabilizer being present. Images tend to have greater appeal when the background color is minimal, and the inclusion of the preferred light-stabilizers thus make for higher visual contrast of the formed images if these are exposed to ambient (white) light for extended periods of time.

EXAMPLE 6

The following coating recipe was used to prepare a solution which was successfully imaged with a YAG laser, with emission at 1064 nm. A solution was prepared with the following ingredients:

2244 mg Methylene chloride
2109 mg Butanone-2
1172 mg Propanol-2
187.5 mg EK Binder 500-5
90.5 mg N-HABI
65.2 mg D-LECV
18.8 mg DEHA
33.0 mg BMPS
22mg RD-1

The solution was coated on 32 HG paper with a #30 wire-wound rod, air dried, and exposed with the YAG-laser device. Sample had background of 0.03. A 1.5 J/cm$^2$ exposure gave reflectance optical density of 1.54; a 0.65 J/cm$^2$ exposure gave reflectance optical density of 0.79.

EXAMPLES 7–10

These examples further illustrate that high optical density values are achieved with compositions containing at least one HABI, at least one leuco dye, and at least one acid-generating compound. Optical densities for samples 7–10 were measured with a Macbeth RD918 reflection densitometer with a neutral filter. In these examples, the measure of room light stability is mOD/fc/hr, defined as follows: Room light stability=increase in optical density after exposure to room light at a measured intensity of 40–100 foot candles for a measured time period of aproximately 12 hours. The units of room light stability are reported in milli-optical density units per foot candle per hour (i.e., mOD/fc/hr). Lower values indicate higher room light stability.

EXAMPLE 7

A solution containing
28.330 g Butanone-2
28.330 g Propanol-2
28.330 g Toluene
5.070 g Butvar® 90 PVB
2.400 g LV-1
2.400 g BHT
0.750 g THDBBP
0.750 g BMPS
3.450 g N-HABI
0.180 g DF-1 was coated onto Reflections Paper and air dried. It gave dry coating weight of 35 mg/dm$^2$ and background optical density of 0.17. Exposure in the CREO unit at 450 mJ/cm$^2$ gave image density of 1.03, or image contrast of 0.86. Room light stability was measured to be 0.34 mOD/fc/hr=milli optical density units per foot candle per hour).

EXAMPLE 8

A solution containing
28.330 g Butanone-2
28.330 g Propanol-2
28.330 g Toluene
5.070 g Butvar® 90 PVB
1.200 g LV-1
1.200 g LV-2
2.400 g BHT
0.750 g THDBBP
0.750 g BMPS
3.450 g N-HABI
0.180 g DF-1 was coated onto Reflections Paper and air dried. It gave dry coating weight of 35 mg/dm$^2$ and background optical density of 0.18. Exposure in the CREO at 450 mJ/cm$^2$ gave image density of 0.99, or image contrast of 0.81. Room light stability was measured to be 0.18 mOD/fc/hr.

EXAMPLE 9

A solution containing
28.330 g Butanone-2
28.330 g Propanol-2
28.330 g Toluene
5.152 g Butvar® 90 PVB
1.220 g LV-1
1.220 g LV-2
2.438 g BHT
0.524 g THBP
0.762 g BMPS
3.506 g N-HABI
0.183 g DF-1 was coated onto Reflections Paper and air dried. It gave dry coating weight of 35 mg/dm$^2$ and background optical density of 0.19. Exposure in the CREO at 450 mJ/cm$^2$ gave image density of 1.06, or image contrast of 0.83. Room light stability was measured to be 0.25 mOD/fc/hr.

EXAMPLE 10

A solution containing
27.00 g Butanone-2
27.00 g Propanol-2
27.00 g Toluene
6.76 g Butvar® 90 PVB
1.600 g LV-1
1.600 g LV-2
3.200 g BHT
0.999 g BMPS
4.600 g N-HABI
0.239 g DF-1 was coated onto Reflections Paper and air dried. It gave dry coating weight of 35 mg/dm$^2$ and background optical density of0.18. Exposure in the CREO unit at 450 mJ/cm$^2$ gave image density of 1.12, or image contrast of 0.94. Room light stability was measured to be 0.30 mOD/fc/hr.

What is claimed is:

1. A thermally imageable element, comprising:

(1) a support; and (2) a thermally imageable composition, comprising:

(a) at least one HABI compound;
(b) at least one leuco dye;
(c) at least one acid-generating compound;
(d) a polymeric binder; and
(e) at least one near IR absorbing dye;

wherein imaging of the composition is by thermal means involving exposing with near-IR radiation using mode 2 with the proviso that the composition is not imaged by UV means.

2. A thermally imageable composition, comprising:

(a) at least one HABI compound;
(b) at least one leuco dye;

(c) at least one acid-generating compound;

(d) a polymeric binder; and (e) at least one near IR-absorbing dye;

wherein imaging of the composition is by thermal means involving exposing with near-IR radiation using mode 2 with the proviso that the composition is not imaged by UV means.

3. The composition of claim 2 wherein the HABI compound is selected from the group consisting of N-HABI, MN-HABI, MCN-HABI and RO-HABI, where R, in the RO-HABI, is a linear or branched $C_1$–$C_6$ alkyl.

4. The composition of claim 2 wherein the polymeric binder is selected from poly(vinyl butyral), cellulose esters and brominated poly(styrene).

5. The composition of claim 2 wherein the optical density obtained upon thermal imaging in mode 2 is at least 0.5 with use of a neutral filter when imaging is effected by near IR radiation of wavelength in the range from 770 nm to 1100 nm and having a fluence level in the range from 250 mJ/cm$^2$ to 1 J/cm$^2$.

6. A thermally imageable element, comprising:

(1) a support; and (2) a thermally imageable composition, comprising:

(a) at least one HABI compound;

(b) at least one leuco dye;

(c) at least one thermolytic acid-generating compound; and (d) a polymeric binder;

wherein the composition does not include at least one microcapsule.

7. The thermally imageable element of claim 6, wherein the composition further comprises at least one inhibitor selected from the group consisting of BHT, PD, DEHA, MBDEEP, and MBDEMP.

8. The thermally imageable element of claim 7, wherein the composition further comprises at least one UV stabilizer, which absorbs at wavelengths greater than or equal to 380 nm, and which is selected from the group consisting of polyhydroxybenzophenones, triarylimidazoles, and hydroxyphenylbenzotriazoles.

9. The thermally imageable element of claim 8 wherein the at least one UV stabilizer present in the composition is selected from the group consisting of DMDHBP, THBP, THDBBP, DHMBP, DHDMDBBP, and DPCPI.

10. The thermally imageable element of claim 6 wherein the acid-generating compound present in the composition is selected from the group consisting of DBTCE, BMPS, DBC, a sulfonium salt of the formula $R_1R_2R_3S^+X^-$, an iodonium salt of the formula $R_1R_2I^+X^-$, and a phosphonium salt of the formula $R_1R_2R_3R_4P^+X^-$, wherein $R_1$–$R_4$ are independently aryl or substituted aryl and X is a monovalent ion.

11. The thermally imageable element of claim 6 wherein the leuco dye of the composition is selected from the group consisting of aminotriarylmethanes, aminoxanthenes, and leuco indigoid dyes.

12. The thermally imageable element of claim 11 wherein the leuco dye is selected from the group consisting of LCV, LV-1, LV-2, LV-3, D-LECV, D-LCV, D-LV-1, D-LV-2, LY-1, and LM-5.

13. The thermally imageable element of claim 6 wherein the HABI compound present in the composition is selected from the group consisting of o-Cl-HABI, TCTM-HABI, CDM-HABI, N-HABI, MN-HABI, MCN-HABI, and RO-HABI, where R, in the RO-HABI, is a linear or branched $C_1$–$C_6$ alkyl group.

14. The thermally imageable element of claim 1 wherein the HABI compound present in the composition is selected from the group consisting of N-HABI, MN-HABI, MCN-HABI and RO-HABI where R, in the RO-HABI, is a linear branched $C_1$–$C_6$ alkyl.

15. The thermally imageable element of claim 6 or claim 14 wherein the polymeric binder of the composition is selected from the group consisting of poly(vinyl butyral), cellulose esters and brominated poly(styrene).

16. The thermally imageable element of claim 1 wherein the optical density obtained upon thermal imaging in mode 2 is at least 0.5 with use of a neutral filter when imaging is effected by near IR radiation of wavelength in the range from 770 nm to 1100 nm and having a fluence level in the range from 250 mJ/cm$^2$ to 1 J/cm$^2$.

17. A thermal process for preparing an image on a substrate comprising, in order:

(i) applying an imageable composition on the substrate, wherein the imageable composition comprises:

(a) at least one HABI compound;

(b) at least one leuco dye;

(c) at least one thermolytic acid-generating compound; and (d) a polymeric binder;

wherein the composition does not include at least one microcapsule;

(ii) imagewise heating the imageable layer to form imaged and non-imaged areas and to thereby form an image on the substrate, wherein the imagewise heating of the composition is by thermal means using mode 1 with the proviso that the composition is not exposed by UV means.

18. A thermal process for preparing an image on a substrate comprising, in order:

(i) applying an imageable composition on the substrate, wherein the imageable composition comprises:

(a) at least one HABI compound;

(b) at least one leuco dye;

(c) at least one acid-generating compound;

(d) a polymeric binder; and (e) at least one near IR absorbing dye;

(ii) imagewise exposing the layer with near-IR radiation to form imaged and non-imaged areas and to thereby form an image on the substrate, wherein the exposure of the imageable layer is effected entirely by thermal means with near-IR radiation using mode 2 with the proviso that the imageable layer is not imaged by UV means.

19. The process of claim 17, wherein the composition further comprises at least one inhibitor selected from the group consisting of BHT, PD, DEHA, MBDEEP, and MBDEMP.

20. The process of claim 19, wherein the composition further comprises at least one UV stabilizer, which absorbs at wavelengths greater than or equal to 380 nm, and which is selected from the group consisting of polyhydroxybenzophenones, triarylimidazoles, and hydroxyphenylbenzotriazoles.

21. The process of claim 20, wherein the at least one UV stabilizer of the composition is selected from the group consisting of DMDHBP, THBP, THDBBP, DHMBP, DHDMDBBP, and DPCPI.

22. The process of claim 17 wherein the acid-generating compound of the composition is selected from the group consisting of DBTCE, BMPS, DBC, a sulfonium salt of the formula $R_1R_2R_3S^+X^-$, an iodonium salt of the formula $R_1R_2I^+X^-$, and a phosphonium salt of the formula $R_1R_2R_3R_4P^+X^-$, wherein $R_1$–$R_4$ are independently aryl or substituted aryl and X is a monovalent ion.

23. The process of claim 17 wherein the leuco dye of the composition is selected from the group consisting of aminotriarylmethanes, aminoxanthenes,and leuco indigoid dyes.

24. The process of claim 23 wherein the leuco dye is selected from the group consisting of LCV, LV-1, LV-2, LV-3, D-LECV, D-LCV, D-LV-1, D-LV-2, LY-1, and LM-5.

25. The process of claim 17 wherein the HABI compound present in the composition is selected from the group consisting of o-Cl-HABI, TCTM-HABI, CDM-HABI, N-HABI, MN-HABI, MCN-HABI, and RO-HABI, where R, in the RO-HABI, is a linear or branched $C_1$–$C_6$ alkyl group.

26. The process of claim 18 wherein the HABI compound present in the composition is selected from the group consisting of N-HABI, MN-HABI, MCN-HABI and RO-HABI, where R, in the RO-HABI, is a linear or branched $C_1$–$C_6$ alkyl.

27. The process of claim 17 or claim 18 wherein the polymeric binder of the imageable composition is selected from the group consisting of poly(vinyl butyral), cellulose esters and brominated poly(styrene).

28. The process of claim 18 wherein the optical density obtained upon thermal imaging in mode 2 is at least 0.5 with use of a neutral filter when imaging is effected by near IR radiation of wavelength in the range from 770 nm to 1100 nm and having a fluence level in the range from 250 mJ/cm$^2$ to 1 J/cm$^2$.

29. An image on a substrate made in accordance with the process of claim 17.

30. An image on a substrate made in accordance with the process of claim 18.

31. A thermal process for preparing an image on a substrate comprising, in order:

(i) applying an imageable composition on the substrate, wherein the imageable composition comprises:
  (a) at least one HABI compound;
  (b) at least one leuco dye;
  (c) at least one acid-generating compound; and
  (d) a polymeric binder;

wherein the composition does not include at least one microcapsules; and wherein the acid-generating compound is selected from iodonium salts; phosphonium salts; sulfonium salts; halogenated compounds having the structure R-CX3, where X is Br, Cl, or I and R is H, R'SO2—, R"CO—, where R, R', and R" are independently alkyl or aryl; and 1,2-dihalogenated ethanes having the structure:

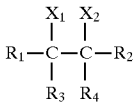

wherein:

X1 and X2 are independently either bromine or chlorine,

R1 is C6–C10 aryl, or aroyl, and R2 is C6–C10 aryl, aroyl, acyl, or an electron withdrawing group other than halogen, R3 and R4 independently are C6–C10 aryl, C1–C10 alkyl, H, or an electron withdrawing group other than halogen with the proviso that any two of R1, R2, R3 and R4 can form a C5–C8 membered ring structure, with the proviso that when R1 or R3 is C6–C10 aryl, R2 and R3 are not aryl; and with the proviso that the composition does not contain explicit acid when all components of the composition are blended together at ambient temperature;

(ii) imagewise heating the imageable layer to form imaged and non-imaged areas and to thereby form an image on the substrate, wherein the imagewise heating of the composition is by thermal means using mode 1 with the proviso that the composition is not exposed by UV means.

32. A process comprising, in order:

(i) applying an imageable composition on the substrate, wherein the imageable composition comprises:
  (a) at least one HABI compound;
  (b) at least one leuco dye;
  (c) at least one thermolytic acid-generating compound; and
  (d) a polymeric binder; wherein the composition does not include at least one microcapsule;

(ii) heating the imageable layer to thereby form a color on the substrate, wherein the heating of the composition is by thermal means using mode 1 with the proviso that the composition is not exposed by UV means.

33. A process comprising, in order:

(i) applying an imageable composition on the substrate, wherein the imageable composition comprises:
  (a) at least one HABI compound;
  (b) at least one leuco dye;
  (c) at least one acid-generating compound;
  (d) a polymeric binder; and
  (e) at least one near IR absorbing dye;

(ii) imagewise exposing the layer with near-IR radiation to thereby form a color on the substrate, wherein the exposure of the imageable layer is effected entirely by thermal means with near-IR radiation using mode 2 with the proviso that the imageable layer is not imaged by UV means.

34. The process of claim 32, wherein the composition further comprises at least one inhibitor selected from the group consisting of BHT, PD, DEHA, MBDEEP, and MBDEMP.

35. The process of claim 34, wherein the composition further comprises at least one UV stabilizer, which absorbs at wavelengths greater than or equal to 380 nm, and which is selected from the group consisting of polyhydroxybenzophenones, triarylimidazoles, and hydroxyphenylbenzotriazoles.

36. The process of claim 35, wherein the at least one UV stabilizer of the composition is selected from the group consisting of DMDHBP, THBP, THDBBP, DHMBP, DHDMDBBP, and DPCPI.

37. The process of claim 32 wherein the acid-generating compound of the composition is selected from the group consisting of DBTCE, BMPS, DBC, a sulfonium salt of the formula $R_1R_2R_3S^+X^-$, an iodonium salt of the formula $R_1R_2I^+X^-$, and a phosphonium salt of the formula $R_1R_2R_3R_4P^+X^-$, wherein $R_1$–$R_4$ are independently aryl or substituted aryl and X is a monovalent ion.

38. The process of claim 32 wherein the leuco dye of the composition is selected from the group consisting of aminotriarylmethanes, aminoxanthenes, and leuco indigoid dyes.

39. The process of claim 38 wherein the leuco dye is selected from the group consisting of LCV, LV-1, LV-2, LV-3, D-LECV, D-LCV, D-LV-1, D-LV-2, LY-1, and LM-5.

40. The process of claim 32 wherein the HABI compound present in the composition is selected from the group consisting of o-Cl-HABI, TCTM-HABI, CDM-HABI, N-HABI, MN-HABI, MCN-HABI, and RO-HABI, where R, in the RO-HABI, is a linear or branched $C_1$–$C_6$ alkyl group.

41. The process of claim 33 wherein the HABI compound present in the composition is selected from the group consisting of N-HABI, MN-HABI, MCN-HABI and RO-HABI, where R, in the RO-HABI, is a linear or branched $C_1$–$C_6$ alkyl.

42. The process of claim 32 or claim 33 wherein the polymeric binder of the imageable composition is selected from the group consisting of poly(vinyl butyral), cellulose esters and brominated poly(styrene).

43. The process of claim 33 wherein the optical density obtained upon thermal imaging in mode 2 is at least 0.5 with use of a neutral filter when imaging is effected by near IR radiation of wavelength in the range from 770 nm to 1100 nm and having a fluence level in the range from 250 mJ/cm$^2$ to 1 J/cm$^2$.

44. An image on a substrate made in accordance with the process of claim 32.

45. An image on a substrate made in accordance with the process of claim 33.

* * * * *